US009387696B2

(12) United States Patent
Hiratsuka et al.

(10) Patent No.: US 9,387,696 B2
(45) Date of Patent: Jul. 12, 2016

(54) PRINTING APPARATUS, PRINTING SYSTEM, AND METHOD FOR MANUFACTURING PRINTED MATERIAL

(71) Applicants: Hiroyuki Hiratsuka, Kanagawa (JP); Koji Nagai, Kanagawa (JP); Satoshi Katoh, Kanagawa (JP); Haruki Saitoh, Kanagawa (JP)

(72) Inventors: Hiroyuki Hiratsuka, Kanagawa (JP); Koji Nagai, Kanagawa (JP); Satoshi Katoh, Kanagawa (JP); Haruki Saitoh, Kanagawa (JP)

(73) Assignee: Ricoh Company,Ltd., Tokyo (JP)

( * ) Notice: Subject to any disclaimer, the term of this patent is extended or adjusted under 35 U.S.C. 154(b) by 0 days.

(21) Appl. No.: 14/642,575

(22) Filed: Mar. 9, 2015

(65) Prior Publication Data

US 2015/0258811 A1 Sep. 17, 2015

(30) Foreign Application Priority Data

Mar. 11, 2014 (JP) ..... 2014-048184
Dec. 4, 2014 (JP) ..... 2014-246217

(51) Int. Cl.
*B41J 11/00* (2006.01)

(52) U.S. Cl.
CPC ..... *B41J 11/0015* (2013.01)

(58) Field of Classification Search
CPC ..... B41J 11/0015
See application file for complete search history.

(56) References Cited

U.S. PATENT DOCUMENTS

| | | | | |
|---|---|---|---|---|
| 8,801,171 | B2 * | 8/2014 | DiRubio et al. | 347/103 |
| 8,985,758 | B2 * | 3/2015 | Mettu et al. | 347/103 |
| 2007/0058019 | A1 | 3/2007 | Saitoh et al. | |
| 2009/0290007 | A1 | 11/2009 | Saitoh et al. | |
| 2011/0064489 | A1 | 3/2011 | Bisaiji et al. | |
| 2011/0199446 | A1 * | 8/2011 | Ram et al. | 347/101 |
| 2013/0250017 | A1 | 9/2013 | Saitoh et al. | |
| 2014/0078212 | A1 | 3/2014 | Nakai et al. | |
| 2014/0160197 | A1 | 6/2014 | Hirose et al. | |
| 2015/0035918 | A1 | 2/2015 | Matsumoto | |

FOREIGN PATENT DOCUMENTS

| | | |
|---|---|---|
| JP | 2009-279796 | 12/2009 |
| JP | 2010-188568 | 9/2010 |
| JP | 2010-201819 | 9/2010 |
| JP | 4662590 | 1/2011 |

* cited by examiner

*Primary Examiner* — Justin Seo
(74) *Attorney, Agent, or Firm* — Duft Bornsen & Fettig LLP

(57) ABSTRACT

A printing apparatus includes a plasma processing unit that processes a surface of a processing object by using plasma; a recording unit that forms a first-color image on the surface of the processing object by inkjet recording, the surface being plasma-processed by the plasma processing unit, and forms a second-color image to be superimposed on the first-color image by the inkjet recording; and an adjusting unit that adjusts a plasma energy amount that is to be applied to the processing object according to the second-color image.

20 Claims, 23 Drawing Sheets

ONE-DOT LINE PATTERN

TWO-DOT LINE PATTERN

FIG.24

| RESOLUTION | PAPER TYPE | | | | | | |
|---|---|---|---|---|---|---|---|
| | PLAIN PAPER A | PLAIN PAPER B | COATED PAPER A | COATED PAPER B | COATED PAPER C | FILM A | FILM B |
| 600 dpi | 0.1 | 0.14 | 1.4 | 2.5 | 5 | 0.1 | 0.2 |
| 1200 dpi | 0.08 | 0.12 | 0.7 | 1.4 | 2.8 | 0.08 | 0.16 |

UNIT: $J/cm^2$

FIG.33

| RESOLUTION | DOT SIZE | DROPLET AMOUNT [pl] | PAPER TYPE | | | | | | |
|---|---|---|---|---|---|---|---|---|---|
| | | | PLAIN PAPER A | PLAIN PAPER B | COATED PAPER A | COATED PAPER B | COATED PAPER C | FILM A | FILM B |
| 600 dpi | SMALL DROPLET | 2.5 | 0.07 | 0.1 | 0.14 | 0.5 | 1 | 0.07 | 0.14 |
| | MEDIUM DROPLET | 6.5 | 0.08 | 0.12 | 0.7 | 1.4 | 2.8 | 0.08 | 0.16 |
| | LARGE DROPLET | 15 | 0.1 | 0.14 | 1.4 | 2.5 | 5 | 0.1 | 0.2 |
| 1200 dpi | SMALL DROPLET | 2 | 0.07 | 0.1 | 0.14 | 0.5 | 1 | 0.07 | 0.14 |
| | MEDIUM DROPLET | 4 | 0.08 | 0.12 | 0.7 | 1.4 | 2.8 | 0.08 | 0.16 |
| | LARGE DROPLET | 6 | 0.08 | 0.12 | 0.7 | 1.4 | 2.8 | 0.08 | 0.16 |

UNIT: $J/cm^2$

PRINTING APPARATUS, PRINTING SYSTEM, AND METHOD FOR MANUFACTURING PRINTED MATERIAL

CROSS-REFERENCE TO RELATED APPLICATIONS

The present application claims priority to and incorporates by reference the entire contents of Japanese Patent Application No. 2014-048184 filed in Japan on Mar. 11, 2014 and Japanese Patent Application No. 2014-246217 filed in Japan on Dec. 4, 2014.

BACKGROUND OF THE INVENTION

1. Field of the Invention

The present invention relates to a printing apparatus, a printing system, and a method for manufacturing a printed material.

2. Description of the Related Art

In the related art, inkjet recording devices are operated mainly in a shuttle method where a head is reciprocally moved in a width direction of a recording medium representatively including a paper or a film, and thus, it is difficult to improve a throughput in high speed printing. Therefore, recently, in order to cope with the high speed printing, there has been proposed a one-pass method where a plurality of heads are arranged so as to cover the entire width of the recording medium and recording is performed at one time.

Although the one-pass method is advantageous to the high speed, since the time interval of ejecting droplets for adjacent dots is short and the droplets of the adjacent dots are ejected before the previously ejected ink is permeated into the recording medium, there is a problem in that coalescence of the adjacent dots (hereinafter, referred to as ejected droplet interference) easily occurs, and image quality is easily deteriorated.

In view of the above situations, there is a need to provide a printing apparatus, a printing system, and a method for manufacturing a printed material capable of manufacturing a high quality printed material.

SUMMARY OF THE INVENTION

It is an object of the present invention to at least partially solve the problems in the conventional technology.

According to an aspect of the present invention, there is provided a printing apparatus that includes a plasma processing unit that processes a surface of a processing object by using plasma; a recording unit that forms a first-color image on the surface of the processing object by inkjet recording, the surface being plasma-processed by the plasma processing unit, and forms a second-color image to be superimposed on the first-color image by the inkjet recording; and an adjusting unit that adjusts a plasma energy amount that is to be applied to the processing object according to the second-color image.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 24 is a diagram illustrating an example of a table used for specifying the ink droplet amount and the plasma energy amount in the flowchart illustrated in FIG. 23;

FIG. 33 is a diagram illustrating an example of a table used for specifying an ink droplet amount and a plasma energy amount in the flowchart illustrated in FIG. 32;

DETAILED DESCRIPTION OF THE PREFERRED EMBODIMENTS

Figure 1:
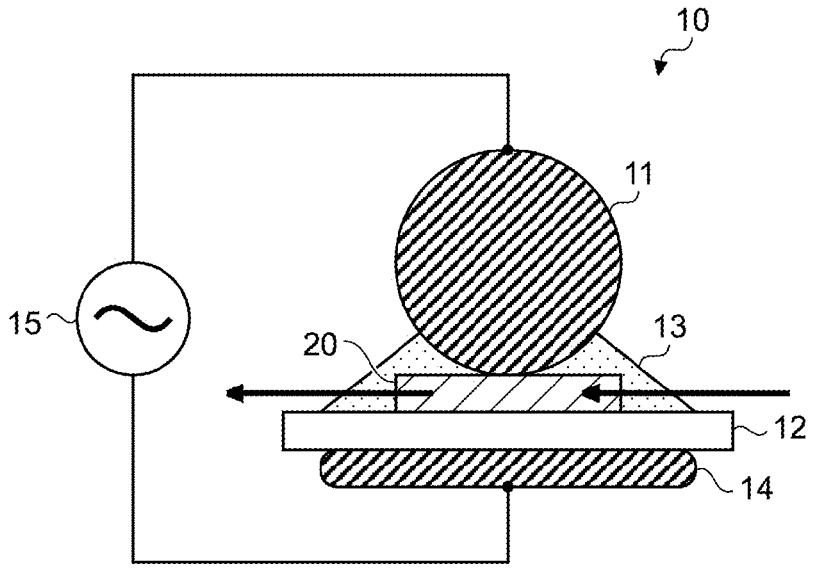
FIG. 1 is a schematic diagram illustrating an example of a plasma processing device for performing a plasma process employed in a first embodiment.

Hereinafter, exemplary embodiments of the invention will be described in detail with reference to the attached drawings. In addition, since the embodiments described hereinafter are exemplary embodiments of the invention, although various preferable limitations are given in terms of technique, the scope of the invention is not limited to the description hereinafter improperly, and all the configurations described in the embodiments are not necessary configurations of the invention.

First Embodiment

First, a printing apparatus, a printing system, and a method for manufacturing a printed material according to the first embodiment of the invention will be described in detail with reference to the drawings. The first embodiment has the following characteristics in order to reform a surface of a processing object so as to be capable of manufacturing a high quality printed material.

Namely, in the first embodiment, a second-color ink dot is landed on an area where the second-color ink dot is superimposed on or adjacent to a first-color ink dot. In such a case, there is a characteristic in that, since a shape change of the second-color ink dot is larger than a shape change of the first-color ink dot, it is easy to detect the shape change of the second-color ink dot. Therefore, by detecting the shape change of the second-color ink dot and adjusting a plasma energy amount in a plasma process based on the detection result, it is possible to more appropriately control wettability of the surface of the processing object which is applied with the plasma process and cohesiveness or permeability of ink pigments caused by a decrease in a pH value. As a result, the coalescence of ink dots is prevented, so that it is possible to expand sharpness of dots or color gamut. Therefore, image defects such as beading or bleed are solved, so that it is possible to obtain a printed material where a high-quality image is formed. In addition, since a thickness of cohered pigments on the surface of the processing object is small and uniform, the ink droplet amount is reduced, so that it is possible to reduce ink drying energy and to reduce a print cost.

In the description of the first embodiment, hereinafter, an example of a plasma process employed in the first embodiment will be first described in detail with reference to the drawings. In the plasma process employed in the first embodiment, by performing plasma irradiation on the processing object in the atmosphere, polymers on the surface of the processing object are reacted, so that hydrophilic functional groups are formed. More specifically, electrons e emitted from a discharging electrode are accelerated in an electric field to excite and ionize atoms or molecules in the atmosphere. The ionized atoms or molecules also emit electrons, so that high energy electrons are increased. As a result, streamer discharge (plasma) occurs. By the high energy electrons in the streamer discharge, polymer binding (a coat layer of the coated paper is able to be hardened by using calcium carbonate and starch as a binder, and the starch has a polymer structure) of the surface of the processing object (for example, a coated paper) cut, and polymers recombine with oxygen radicals O*, hydroxyl radicals (—OH) or ozone $O_3$ in gas phase. This process is called a plasma process. By this process, polarity functional groups such as hydroxyl groups or carboxyl groups are formed on the surface of the processing object. As a result, hydrophilicity or acidity is given to the surface of the processing object. In addition, due to the increase of carboxyl groups, the surface of the processing object is acidified (pH value is decreased).

The hydrophilicity of the surface of the processing object is increased, so that the adjacent dots on the surface of the processing object are wetted and spread to be coalesced. In order to prevent the occurrence of a mixed color between the dots caused by the coalescence, colorants (for example, pigments or dyes) need to be rapidly cohered inside the dots, or vehicles need to be more speedily dried or permeated into the processing object than the vehicles are wetted and spread. Since the plasma process exemplified in the above description also functions as an acidification processing unit (process) for acidifying the surface of the processing object, it is possible to increase the cohesion speed of the colorants inside the dots. In terms of this point, it is considered that the plasma process is effectively performed as a pre-process of the inkjet recording process.

In the first embodiment, an atmospheric pressure non-equilibrium plasma process using dielectric barrier discharge may be employed as the plasma process. In the acidification process using the atmospheric pressure non-equilibrium plasma, since electron temperature is very high and gas temperature is around the room temperature, the process is one of the preferred methods as the plasma processing method which is to be performed on the processing object such as a recording medium.

As a method of extensively and stably generating the atmospheric pressure non-equilibrium plasma, there is an atmospheric pressure non-equilibrium plasma process employing streamer breakdown type dielectric barrier discharge. The streamer breakdown type dielectric barrier discharge is able to be obtained, for example, by applying an alternating high voltage between electrodes covered with a dielectric material. However, as the method of generating the atmospheric pressure non-equilibrium plasma, various methods are able to be used besides the above-described streamer breakdown type dielectric barrier discharge. For example, dielectric barrier discharge where an insulating material such as a dielectric material is inserted between electrodes, corona discharge where significantly non-uniform electric field is formed in a thin metal wire or the like, pulsed discharge where a short pulse voltage is applied, or the like may be employed. In addition, a combination of two or more of these methods may also be available.

FIG. 1 is a schematic diagram illustrating an example of a plasma processing device for performing a plasma process employed in the first embodiment. As illustrated in FIG. 1, in the plasma process employed in the first embodiment, a plasma processing device 10 including a discharging electrode 11, a counter electrode (referred to as a ground electrode) 14, a dielectric material 12, a high-frequency high-voltage power supply 15 may be used. The dielectric material 12 is arranged between the discharging electrode 11 and the counter electrode 14. The discharging electrode 11 and the counter electrode 14 may be electrodes of which metal portions are exposed or may be electrodes which are covered with a dielectric material or an insulating material such as an insulating rubber or ceramics. The dielectric material 12 arranged between the discharging electrode 11 and the counter electrode 14 may be an insulating material such as polyimide, silicon, or ceramics. In addition, in a case where the corona discharge is employed as the plasma process, the dielectric material 12 may be omitted. However, for example, in a case where the dielectric barrier discharge is employed, sometimes, the dielectric material 12 may be preferably installed. In this case, if the dielectric material 12 is arranged at the position so as to be close to or in contact with the counter electrode 14 side rather than the position so as to close to or in contact with the discharging electrode 11 side, the area of surface discharge is expanded, so that it is possible to further improve the effect of the plasma process. The discharging electrode 11 and the counter electrode 14 (or the dielectric material 12 of the electrode of the side where the dielectric material 12 is installed) may be arranged at the position which is in contact with the processing object 20 passing between the two electrodes or may be arranged at the position which is not in contact with the processing object.

The high-frequency high-voltage power supply 15 applies a high-frequency high-voltage pulse voltage between the discharging electrode 11 and the counter electrode 14. The voltage value of the pulse voltage is set to, for example, about 10 kV (p-p). The frequency may be set to, for example, about 20 kHz. By applying the high-frequency high-voltage pulse voltage between the two electrodes, an atmospheric pressure non-equilibrium plasma 13 occurs between the discharging electrode 11 and the dielectric material 12. The processing object 20 passes between the discharging electrode 11 and the dielectric material 12 during the occurrence of the atmospheric pressure non-equilibrium plasma 13. Therefore, the surface of the processing object 20 facing the discharging electrode 11 side is plasma-processed.

In addition, in the plasma processing device 10 exemplified in FIG. 1, a rotation type discharging electrode 11 and a belt-conveyor-type dielectric material 12 are employed. The processing object 20 is interposed and transported between the rotating discharging electrode 11 and the rotating dielectric material 12 to pass through the atmospheric pressure non-equilibrium plasma 13. Therefore, the surface of the processing object 20 is in contact with the atmospheric pressure non-equilibrium plasma 13, and the uniform plasma process is performed on the surface. However, the plasma processing device employed in the first embodiment is not limited to the configuration illustrated in FIG. 1. For example, various modifications such as a configuration where the discharging electrode 11 is not in contact with the processing object 20 but close to the processing object or a configuration where the discharging electrode 11 together with the inkjet head is mounted on the same carriage may be available.

Figure 2:
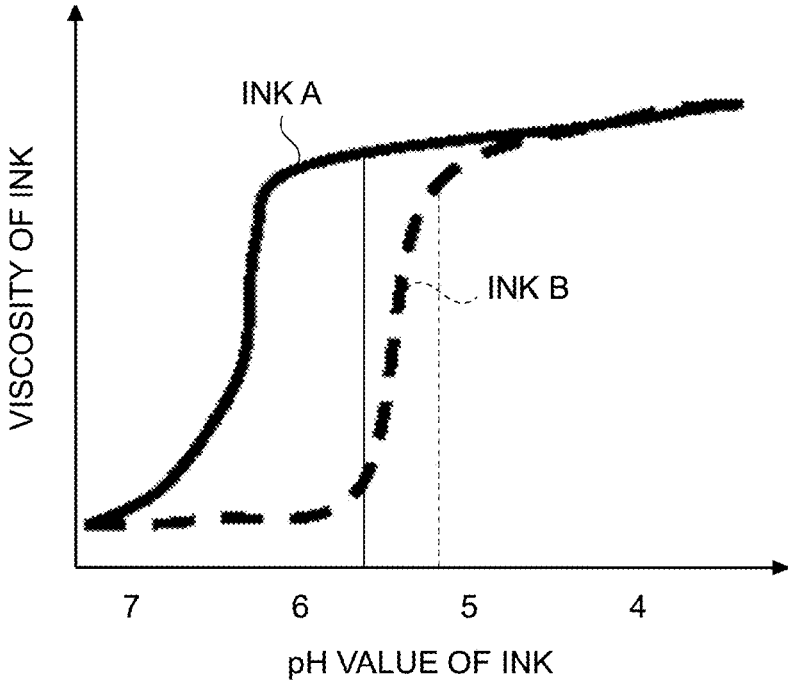
FIG. 2 is a diagram illustrating an example of a relationship between a pH value of ink and a viscosity of ink in the first embodiment.

In the description, the acidification denotes the decrease of the pH value of the surface of the printing medium down to the pH value where the pigments contained in the ink are cohered. The decrease of the pH value denotes the increase of concentration of hydrogen ions $H^+$ in the material. The pigments in the ink before being in contact with the surface of the processing object is negatively charged and dispersed in a liquid such as a vehicle. FIG. 2 illustrates a relationship between the pH value of the ink and the viscosity of the ink. As illustrated in FIG. 2, as the pH value of the ink is decreased, the viscosity of the ink is increased. This is because, as the acidity of the ink is increased, the pigments negatively charged in the vehicle of the ink are electrically neutralized, and as a result, the pigments are cohered. Therefore, for example, in the graph illustrated in FIG. 2, by decreasing the pH value of the surface of the printing medium so that the pH value of the ink becomes the value corresponding to the required viscosity, it is possible to increase the viscosity of the ink. This is because, when the ink is attached to the surface of the printing medium which is acidic, the pigments are electrically neutralized by the hydrogen ions $H^+$ on the surface of the printing medium, and as a result, the pigments are cohered. Therefore, it is possible to prevent the occurrence of a mixed color between adjacent dots and to prevent the pigments from permeating deeply (or to the rear surface) into the printing medium. However, in order to decrease the pH value of the ink down to the pH value corresponding to the required viscosity, the pH value of the surface of the printing medium needs to be set to be lower than the pH value of the ink corresponding to the required viscosity.

The pH value for setting the ink to have the required viscosity is different according to the characteristics of the ink. Namely, as illustrated in an ink A of FIG. 2, there is an ink where the pigments are cohered in the pH value near to a relatively neutral value so that the viscosity is increased, as illustrated in an ink B having characteristics different from those of the ink A, there is an ink where the pH value lower than that of the ink A is required in order to cohere the pigments.

The behavior of cohesion of the colorants inside the dots, the dry speed of the vehicle, the speed of permeation into the processing object are different according to the liquid droplet amount changed by the size (small, medium, or large droplet) of the dots, the type of the processing object, and the like. Therefore, in the first embodiment, the plasma energy amount in the plasma process may be controlled to be an optimal value according to the type of the processing object, the printing mode (liquid droplet amount), and the like.

Figure 3:
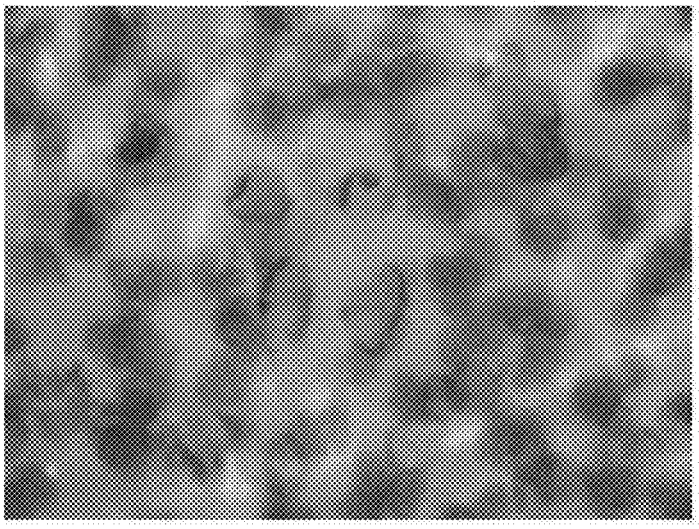
FIG. 3 is an enlarged diagram illustrating an image obtained by imaging an image formation surface of a printed material obtained by performing an inkjet recording process on a processing object which is not applied with the plasma process according to the first embodiment.
Figure 4:
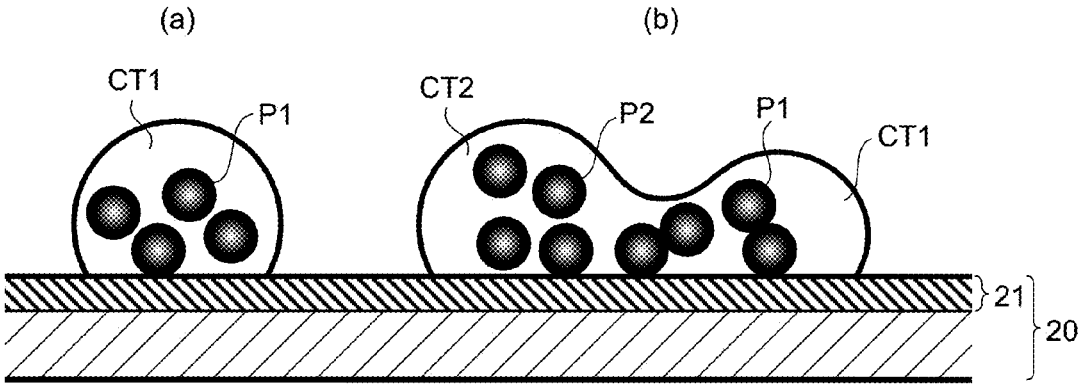
FIG. 4 is a schematic diagram illustrating an example of dots formed on the image formation surface of the printed material illustrated in FIG. 3.
Figure 5:
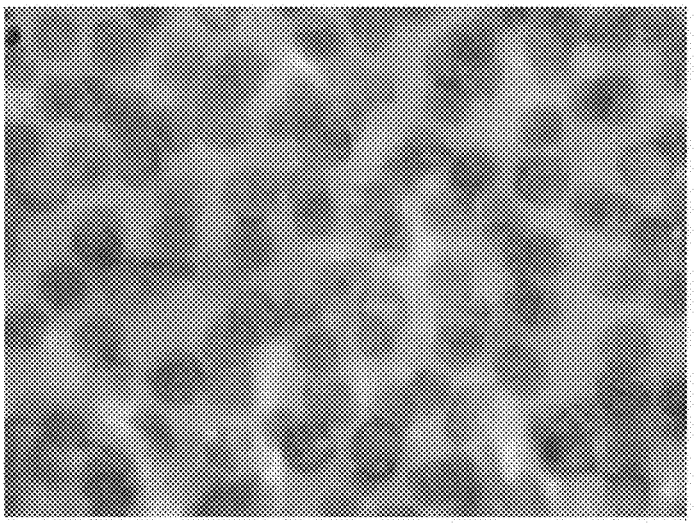
FIG. 5 is an enlarged diagram illustrating an image obtained by imaging an image formation surface of a printed material obtained by performing an inkjet recording process on a processing object which is applied with the plasma process according to the first embodiment.
Figure 6:
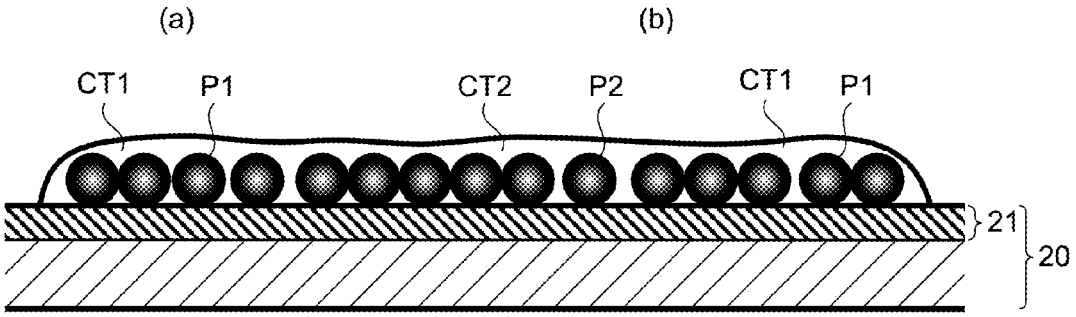
FIG. 6 is a schematic diagram illustrating an example of dots formed on the image formation surface of the printed material illustrated in FIG. 5.

Herein, a difference in the printed material between a case where the plasma process according to the first embodiment is applied and a case where the plasma process according to the first embodiment is not applied will be described with reference to FIGS. 3 to 6. FIG. 3 is an enlarged diagram illustrating an image obtained by imaging an image formation surface of a printed material obtained by performing an inkjet recording process on a processing object which is not applied with the plasma process according to the first embodiment, and FIG. 4 is a schematic diagram illustrating an example of dots formed on the image formation surface of the printed material illustrated in FIG. 3. FIG. 5 is an enlarged diagram illustrating an image obtained by imaging an image formation surface of a printed material obtained by performing an inkjet recording process on a processing object which is applied with the plasma process according to the first embodiment, and FIG. 6 is a schematic diagram illustrating an example of dots formed on the image formation surface of the printed material illustrated in FIG. 5. In addition, in the obtaining of the printed materials illustrated in FIGS. 3 and 5, a desktop type inkjet recording device was used. As the processing object 20, a general coated paper having a coat layer 21 was used.

With respect to the coated paper which is not applied with the plasma process, the wettability of the coat layer 21 on the surface of the coated paper is poor. Therefore, in the image formed through the inkjet recording process on the coated paper which is applied with the plasma process, for example, as illustrated in FIGS. 3 and 4, the shape (shape of a vehicle CT1) of the dots attached to the surface of the coated paper during the landing of the dots is deformed. If proximate dots are formed in the state where the dots are not sufficiently dried, as illustrated in FIGS. 3 and 4, the vehicles CT1 and CT2 are coalesced during the landing of the proximate dots on the coated paper, and thus, the movement (mixed color) of the pigments P1 and P2 occurs between the dots. As a result, in some cases, the irregularity of concentration may occur according to the beading or the like.

On the other hand, with respect to the coated paper which is applied with the plasma process according to the first embodiment, the wettability of the coat layer 21 on the surface of the coated paper is improved. Therefore, in the image formed through the inkjet recording process on the coated paper which is applied with the plasma process, for example, as illustrated in FIG. 5, the vehicle CT1 is spread in a relatively flat circular shape on the surface of the coated paper. Therefore, as illustrated in FIG. 6, the dots have a flat shape. In addition, since the surface of the coated paper becomes acidic due to the polarity functional groups formed in the plasma process, the ink pigments are electrically neutral, and thus, the pigments P1 are cohered, so that the viscosity of the ink is increased. Therefore, even in a case where the vehicles CT1 and CT2 are coalesced as illustrated in FIG. 6, the movement (mixed color) of the pigments P1 and P2 is suppressed between the dots. Furthermore, since the polarity functional groups are also generated inside the coat layer 21, the permeability of the vehicle CT1 is increased. Accordingly, it is possible to dry within a relative short time. The dots which are spread in a circular shape due to the improvement of the wettability are permeated to be cohered, and thus, the pigments P1 are cohered uniformly in the height direction, so that it is possible to prevent the occurrence of the irregularity of concentration caused by the beading or the like. In addition, FIGS. 4 and 6 are schematic diagrams, and actually even in the case of FIG. 6, the pigments are formed as a layer to be cohered.

In this manner, with respect to the processing object 20 which is applied with the plasma process according to the first embodiment, the hydrophilic functional group are generated on the surface of the processing object 20 through the plasma process, and the wettability is improved. Furthermore, the roughness of the surface of the processing object 20 is increased due to the plasma process, and as a result, the wettability of the surface of the processing object 20 is further improved. Furthermore, as a result of the formation of the polarity functional groups through the plasma process, the surface of the processing object 20 becomes acidic. Therefore, the landed ink is uniformly spread on the surface of the processing object 20, and the negatively charged pigments are neutralized on the surface of the processing object 20 to be cohered, so that the viscosity is increased. As a result, even in the dots are coalesced, it is possible to suppress the movement of the pigments. Furthermore, the polarity functional groups are generated inside the coat layer 21 formed on the surface of the processing object 20, and thus, the vehicle is rapidly permeated into the processing object 20, so that it is possible to shorten the dry time. Namely, the dots which are spread in a circular shape due to the increase of the wettability are permeated in the state where the movement of the pigments is suppressed due to the cohesion, so that it is possible to maintain the shape close to a circle.

Figure 7:
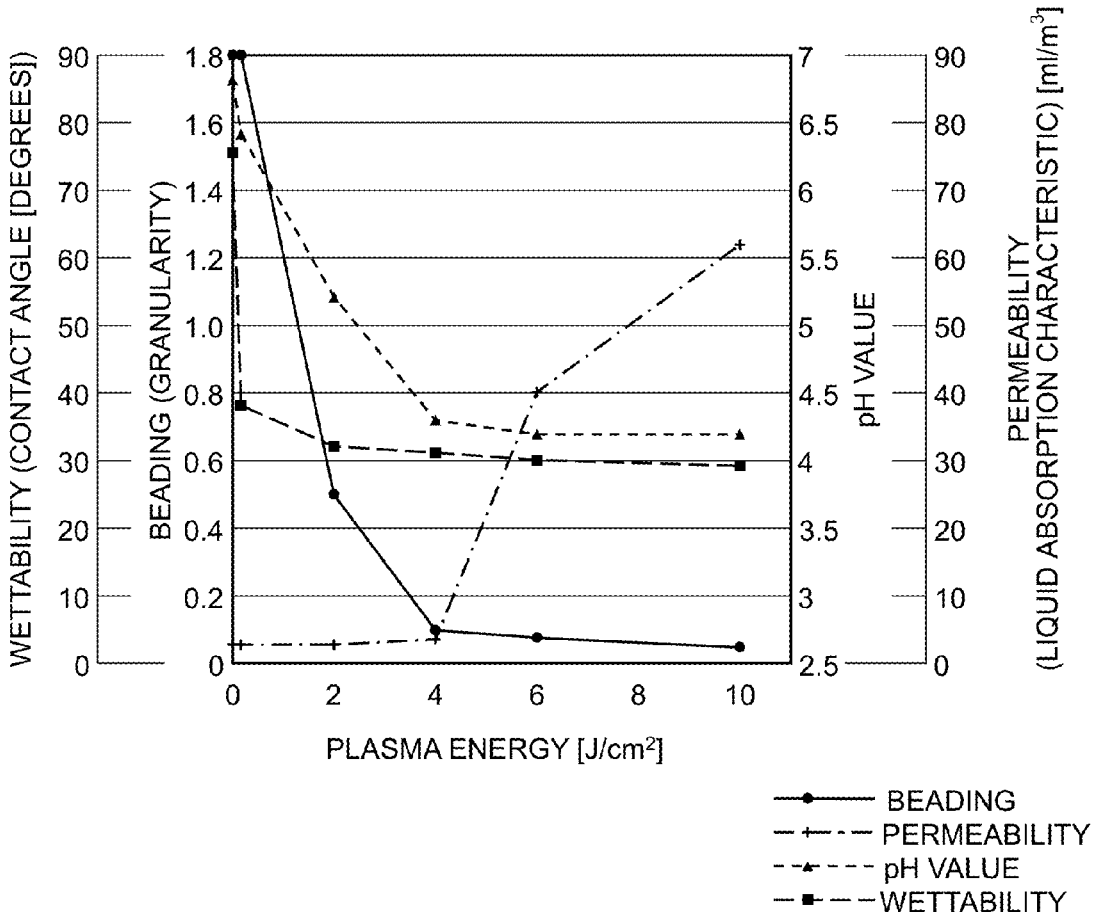
FIG. 7 is a graph illustrating relationships between a plasma energy amount and wettability, beading, pH value, and permeability of a surface of the processing object according to the first embodiment.

FIG. 7 is a graph illustrating relationships between the plasma energy and the wettability, the beading, the pH value, and the permeability of the surface of the processing object according to the first embodiment. FIG. 7 illustrates how the surface characteristics (wettability, beading, pH value, and permeability (liquid absorption characteristic)) of the coated paper printed as the processing object 20 are changed depending on the plasma energy. In addition, in the obtaining the evaluation illustrated in FIG. 7, an aqueous pigment ink (alkaline ink where negatively charged pigments are dispersed) having a characteristic that the pigments are cohered by an acid was used as the ink.

As illustrated in FIG. 7, the wettability of the surface of the coated paper are rapidly increased as the plasma energy is decreased to be a low value (for example, about 0.2 $J/cm^2$ or less), and the wettability is not greatly improved as the plasma energy is increased to be larger than the value. On the other hand, the pH value of the surface of the coated paper is lowered down to some level as the plasma energy is increased. However, if the plasma energy exceeds a certain value (for example, about 4 $J/cm^2$), the pH value is saturated. The permeability (liquid absorption characteristic) is rapidly increased in the vicinity of the plasma energy (for example, about 4 $J/cm^2$) where the decreased pH is saturated. However, this phenomenon is different depending on the polymer component contained in the ink.

As described above, with respect to the relationship between the characteristics of the surface of the processing object 20 and the image quality, as the wettability of the surface is increased, the dot circularity is improved. It is considered to be the reason that the roughness of the surface is increased due to the plasma process and the wettability of the surface of the processing object 20 is improved and becomes uniform due to the generated hydrophilic polarity functional groups. It is also considered to be one factor that water repellent factors such as dust, oil, and calcium carbonate of the surface of the processing object 20 is removed by the plasma process. Namely, it is considered that the wettability of the surface of the processing object 20 is improved and the factor of the instability of the surface of the processing object 20 is removed, and as a result, the liquid droplets are spread uniformly in the circumferential direction, so that the dot circularity is improved.

Furthermore, due to the acidification (decrease of the pH) of the surface of the processing object 20, the cohesion of the ink pigments, the improvement of the permeability, the permeation of the vehicle into the coat layer, and the like occur. Therefore, since the concentration of pigments on the surface of the processing object 20 is increased, even in a case where the dots are coalesced, the movement of the pigments is able to be suppressed, and as a result, turbidness of the pigments is suppressed, so that it is possible to allow the pigments to be uniformly precipitated and cohered onto the surface of the processing object. However, the effect of the suppression of the turbidness of the pigments is different depending on the ink component or the ink droplet amount. For example, in the case of the ink droplet amount is small, the turbidness of the pigments caused by the coalescence of the dots does not easily occur in comparison with the case of large droplets. This is because, in a case where the vehicle amount is an amount of the small droplet, the vehicle is more rapidly dried and permeated, and the pigments are able to be cohered by a small pH reaction. In addition, the effect of the plasma process varies with the type of the processing object 20 or environment (humidity or the like). Therefore, the plasma energy amount in the peripheral portion may be controlled to be an optimal value according to the liquid droplet amount, the type of the processing object 20, the environment, or the like. As a result, there exists a case where the reforming efficiency of the surface of the processing object 20 is improved and further energy saving is able to be achieved.

Figure 8:
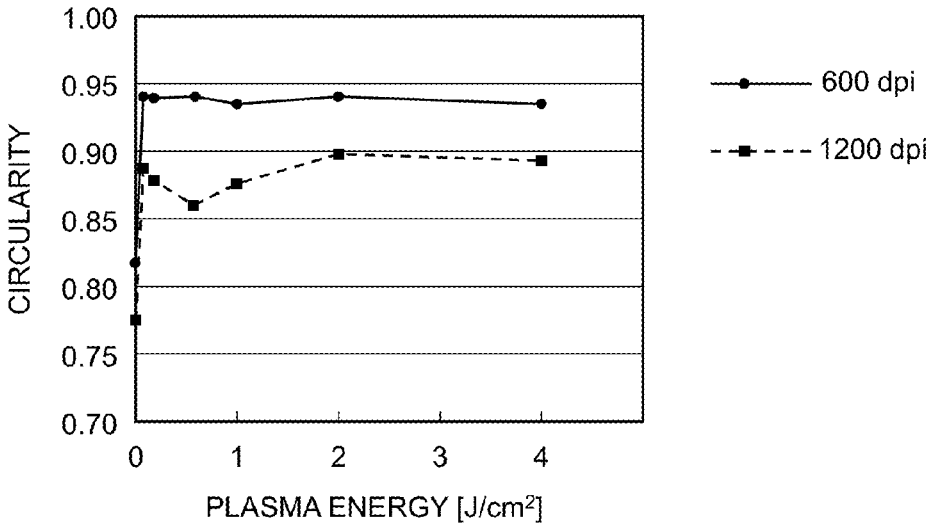
FIG. 8 is a graph illustrating a relationship between the plasma energy amount and the dot circularity according to the first embodiment.
Figure 9:
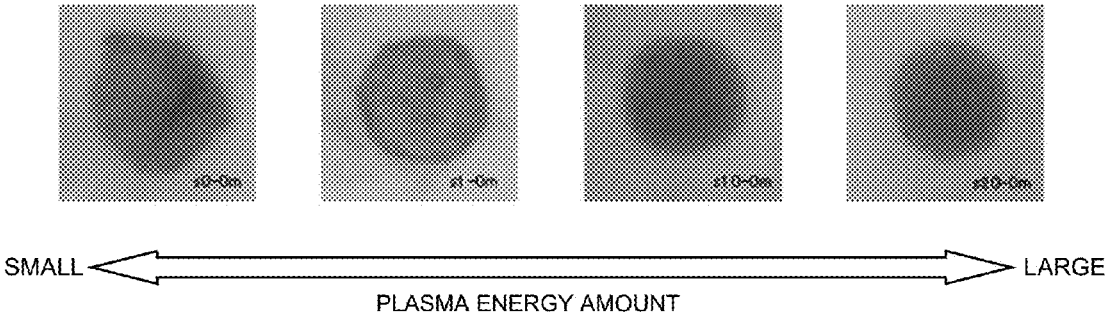
FIG. 9 is a diagram illustrating a relationship between the plasma energy amount and a shape of actually formed dots according to the first embodiment.

Subsequently, a relationship between the plasma energy and the dot circularity will be described. FIG. 8 is a graph illustrating the relationship between the plasma energy and the dot circularity. FIG. 9 is a diagram illustrating a relationship between the plasma energy and a shape of actually formed dots. In addition, FIGS. 8 and 9 illustrate a case where the ink of the same color and the same type is used.

As illustrated in FIGS. 8 and 9, the dot circularity is greatly improved although the plasma energy has a low value (for example, about 0.2 J/cm$^2$ or less). As described above, it is considered that this is because, by performing the plasma process on the processing object 20, the viscosity of the dots (vehicles) is increased and the permeability of the vehicle is increased, so that the pigments are uniformed cohered.

Figure 10:
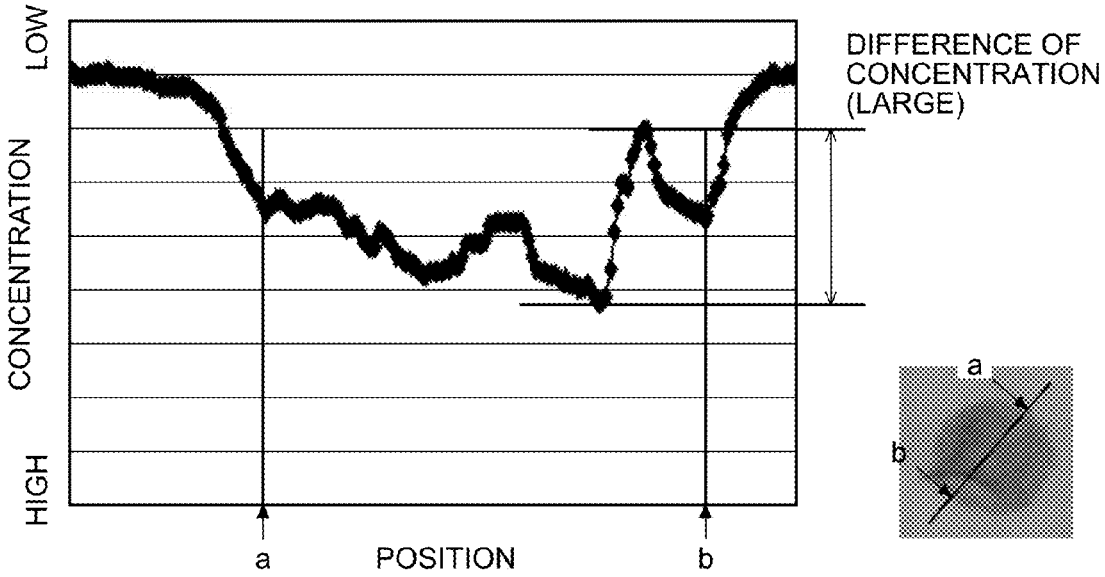
FIG. 10 is a graph illustrating a concentration of pigments in a dot in a case where the plasma process according to the first embodiment is not performed.
Figure 11:
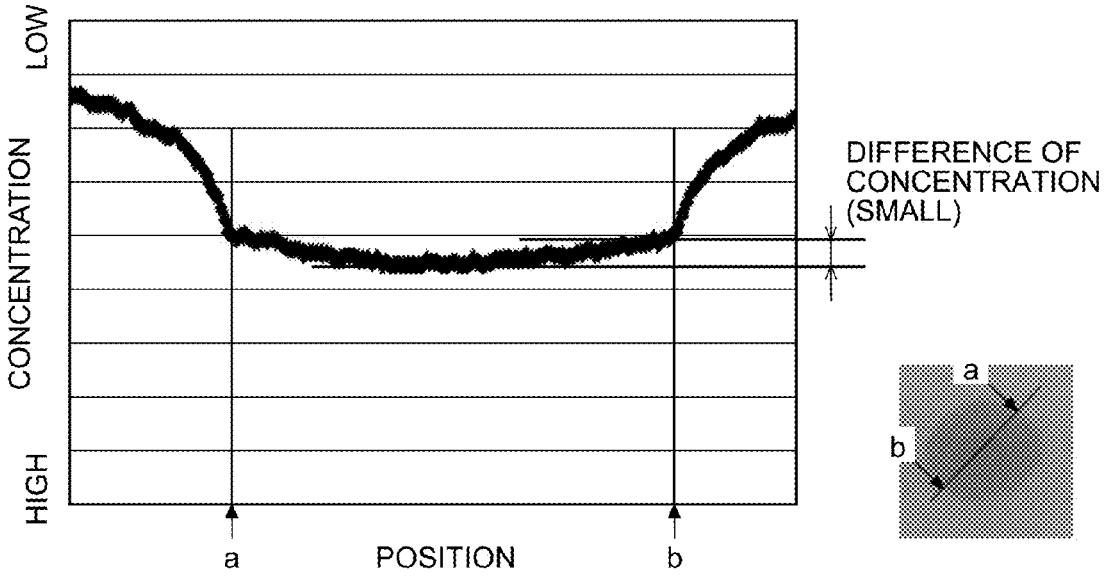
FIG. 11 is a graph illustrating a concentration of pigments in a dot in a case where the plasma process according to the first embodiment is performed.

The irregularity of concentration in the dot between a case where the plasma process is performed and a case where the plasma process is not performed will be described. FIG. 10 is a graph illustrating a concentration in a dot in a case where the plasma process according to the first embodiment is not performed. FIG. 11 is a graph illustrating a concentration of pigments in a dot in a case where the plasma process according to the first embodiment is performed. Each of FIGS. 10 and 11 illustrates the concentration on line a-b of the dot image in the lower right portion of each figure.

In the measurement of FIGS. 10 and 11, the image of the formed dots is captured, and the irregularity of concentration in the image is measured, so that the variation of concentration is calculated. As clarified from the comparison between the FIGS. 10 and 11, in the case of the plasma process is performed (FIG. 11), the variation of concentration (difference of concentration) is able to be reduced in comparison with a case where the plasma process is not performed (FIG. 10). Therefore, the plasma energy amount in the plasma process may be optimized based on the variation of concentration obtained by the above-described calculation method so that the variation (difference of concentration) becomes smallest. Accordingly, it is possible to form a clearer image.

In addition, the calculation of the variation of concentration is not limited to the above-described calculation method, but the variation of concentration may be calculated by measuring the thickness of the pigments by an optical interference film thickness measurement unit. In this case, the optimal value of the plasma energy amount may be selected so as to minimize the deviation of the thickness of the pigments.

In addition, FIGS. 8 to 11 illustrate an example of a result of the measurement of the first-color dots formed on the surface of the processing object. With respect to the second-color dots, the same measurement method as that of the first-color dots may be used in order to obtain the result illustrated in FIGS. 8 to 11.

Next, a shape change of the ink dots between the case (hereinafter, referred to as singular recording) of directly forming the ink dots on the processing object 20 and the case (hereinafter, referred to as superimposition-recording) of forming an image (for example, a solid image) as a base and further forming ink dots thereon will be described in detail hereinafter with reference to the drawings.

Figure 12:
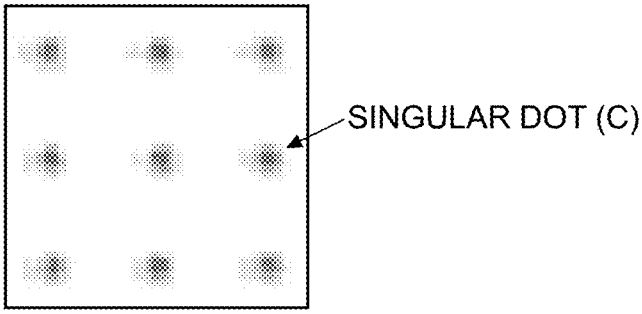
FIG. 12 is an enlarged captured image diagram illustrating a printed material obtained by directly forming (singular recording) ink dots (singular dots) on a surface of a processing object which is not applied with the plasma process according to the first embodiment.
Figure 13:
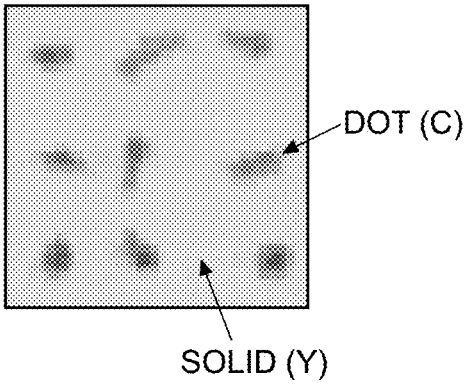
FIG. 13 is an enlarged captured image diagram illustrating a printed material obtained by forming (superimposition-recording) a first-color solid image as a base on a surface of a processing object which is not applied with the plasma process according to the first embodiment and, after that, forming second-color ink dots thereon.

FIG. 12 is an enlarged captured image diagram illustrating a printed material obtained by directly forming (singular recording) ink dots (singular dots) on the surface of the processing object which is not applied with the plasma process. FIG. 13 is an enlarged captured image diagram illustrating a printed material obtained by forming (superimposition-recording) a first-color solid image as a base on a surface of a processing object which is not applied with the plasma process and, after that, forming second-color ink dots thereon. In FIGS. 12 and 13, as the ink for measuring the shape change (the first-color ink in FIG. 12 and the second-color ink in FIG. 13), cyan (C) is used. In FIG. 13, as the ink (first-color ink) for the base (solid portion), yellow (Y) is used. As the processing object 20, a general coated paper having the coat layer 21 is used.

As illustrated in FIG. 12, in a case where the singular recording is performed on the coated paper which is not applied with the plasma process, during the landing of the dots, the shape of the dots attached to the surface of the coated paper is deformed, and the pigments are not sufficiently cohered. However, since the dot pattern formed on the surface of the coated paper is singular dots where other color inks, adjacent dots, or the like are not arranged, a mixed color between the dots does not occur, and the shape change of the dots is small.

On the other hand, as illustrated in FIG. 13, in a case where the superimposition-recording is performed on the coated paper, since the second-color dots are formed in the state where the first-color dots are not sufficiently permeated and dried, a mixed color of the ink at the boundary of the first-color dots and the second-color dots occurs, and as a result, the shape of second-color dots is greatly changed. This denotes that, in the case of observing the second-color dots formed in the superimposition-recording manner, the shape change is easy to detect in comparison with the case of observing the singular dots formed in the singular recording manner. In the example illustrated FIG. 13, similarly to the example illustrated in FIG. 12, the coated paper which is not applied with the plasma process is used.

Next, with respect to a case where the superimposition-recording is performed, the shape change of the dots between the case of applying the plasma process on the processing object 20 and the case of not applying the plasma process will be described in detail hereinafter with reference to the drawings.

Figure 14:
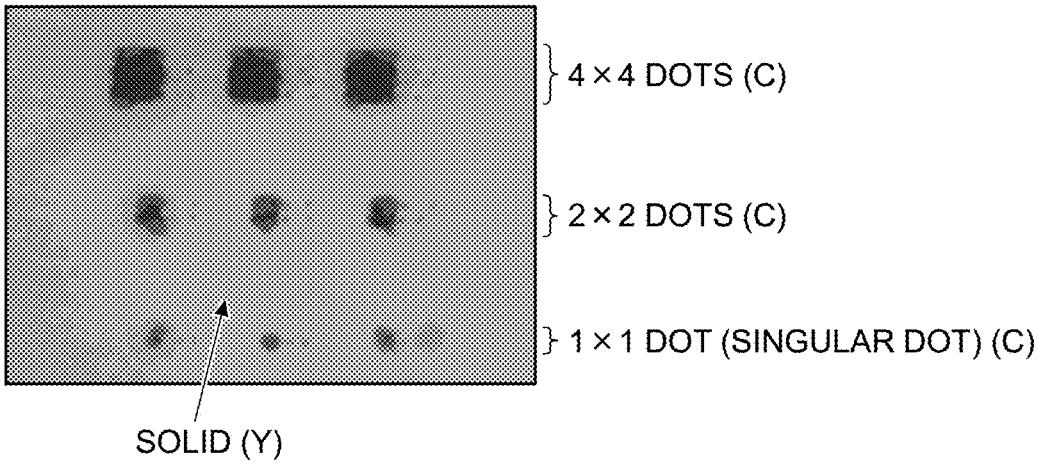
FIG. 14 is an enlarged captured image diagram illustrating a printed material obtained by performing superimposition-recording on a surface of a processing object which is applied with the plasma process according to the first embodiment.
Figure 15:
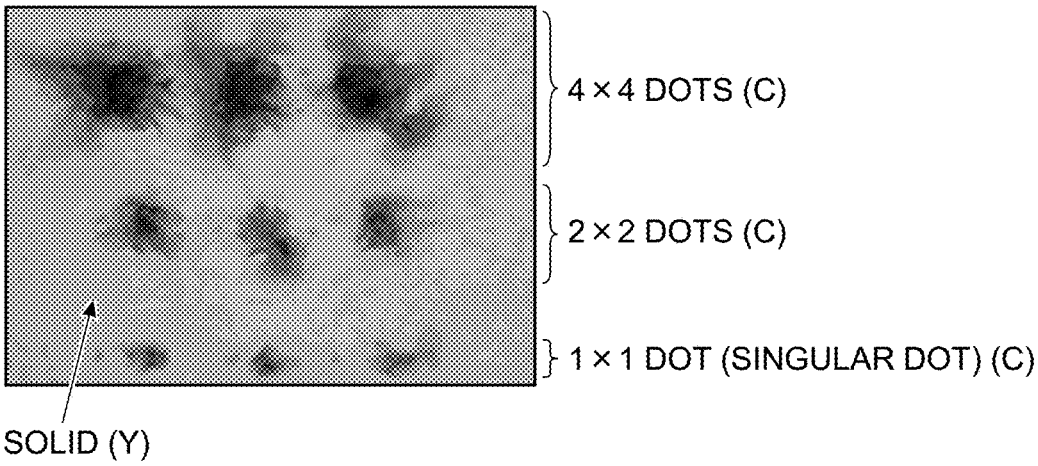
FIG. 15 is an enlarged captured image diagram illustrating a printed material obtained by performing superimposition-recording on a surface of a processing object which is not applied with the plasma process according to the first embodiment.

FIG. 14 is an enlarged captured image diagram illustrating a printed material obtained by performing superimposition-recording on the surface of the processing object which is applied with the plasma process. FIG. 15 is an enlarged captured image diagram illustrating a printed material obtained by performing superimposition-recording on the surface of the processing object which is not applied with the plasma process. In FIGS. 14 and 15, similarly to FIG. 13, as the first-color ink, yellow (Y) is used, and as the second-color ink, cyan (C) is used. As the processing object 20, similarly to FIGS. 12 and 13, a general coated paper having the coat layer 21 is used.

As illustrated in FIG. 14, with respect to the surface of the coated paper which is applied with the plasma process, by improving the wettability of the surface due to the polarity functional groups formed through the plasma process, the first-color dots are spread relatively flat and permeated. Therefore, in comparison with a case where the plasma process illustrated in FIG. 15 is not applied, the mixture of ink is reduced. Furthermore, as a result of the acidification of surface of the coated paper by the polarity functional groups, the pH value of the first-color ink is neutralized and decreased, so that the pigments in the first-color dots are cohered and, thus, the viscosity of the ink is increased. As a result, in the image illustrated in FIG. 14, the mixture of the first-color dots and the second-color dots formed thereon is suppressed. Furthermore, the pH value of the second-color dots is decreased by being in contact with the first-color dots of which the pH value is decreased. Therefore, similarly to the first-color dots, the pigments in the second-color dots are cohered, and thus, the viscosity of the ink is increased, so that the shape of the second-color dots is also maintained.

In addition, the printed material illustrated in FIGS. 12 to 15 is formed by using a desktop inkjet recording device. In the inkjet recording device, an image of 600 dpi is formed by scanning the inkjet head one time. In addition, a landing time difference between the formation of the first-color ink dots and the formation of the second-color ink dots is about 40 milli-seconds, and the ink droplet amount is 9 pL (pico liters) per dot.

Figure 16:
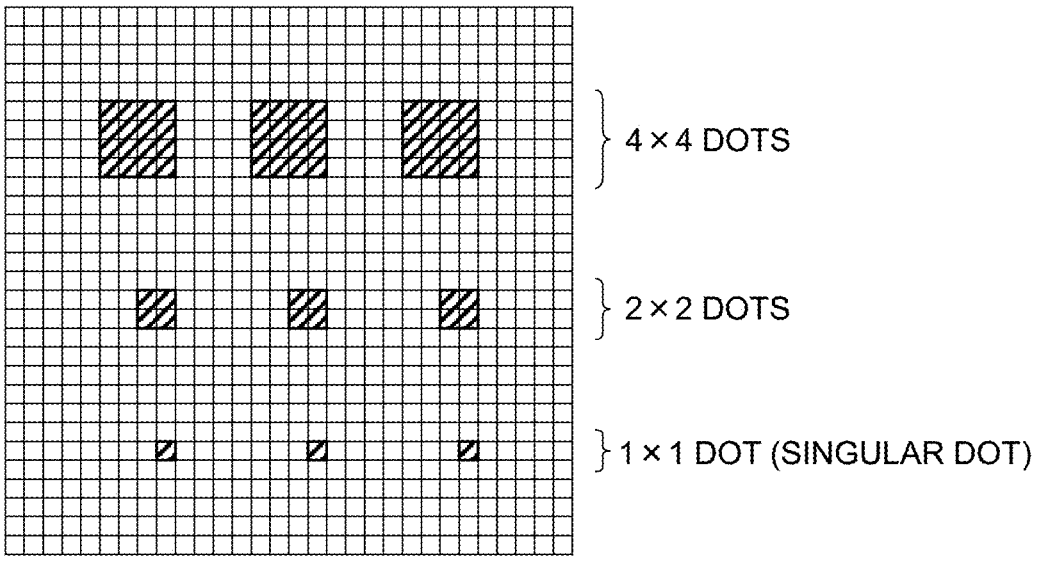
FIG. 16 is a diagram illustrating a test pattern used for forming the printed materials illustrated in FIGS. 14 and 15.

In addition, in the formation of the printed material illustrated in FIGS. 14 and 15, as the second-color ink dot pattern, a test pattern including 4×4 dots, 2×2 dots, and 1×1 dots (singular dots) illustrated in FIG. 16 is used. However, the invention is not limited to the test pattern, and for example, various test patterns such as a test pattern of a one-dot line illustrated in FIG. 17 or a test pattern of a two-dot line illustrated in FIG. 18 may be employed.

Figure 19:
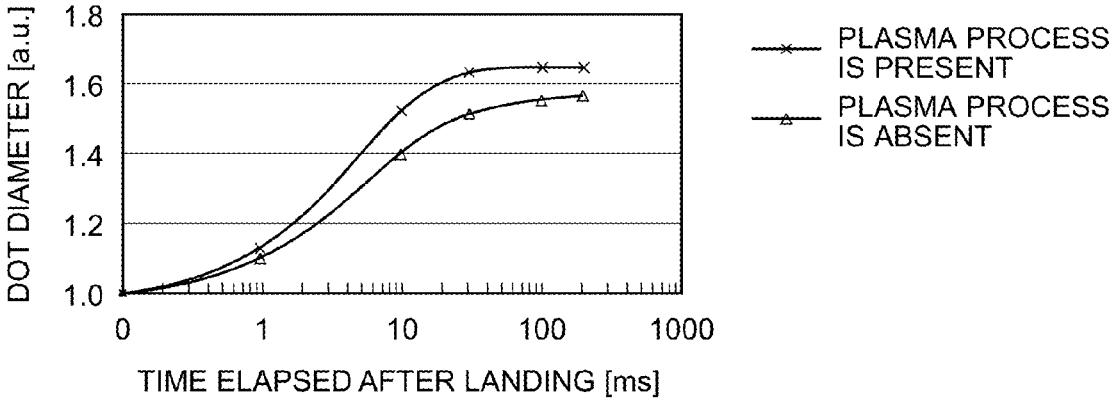
FIG. 19 is a graph illustrating a result of measurement of a change in diameter of ink dots from a time of landing on a surface of the processing object according to the first embodiment by using a high speed camera.

FIG. 19 illustrates a result of measurement of a change in diameter of ink dots from a time of landing on the surface of the processing object by using a high speed camera. In addition, as the processing object 20, general coated paper having the coat layer 21 is used. In a case where the plasma process is applied, the plasma energy is set to 2.8 J/cm$^2$. The ink droplet amount is set to 50 pL, and images are periodically captured up to 200 ms after the landing. The dot diameters are measured from still images obtained each time.

As illustrated in FIG. 19, in a case where the plasma process is applied (plasma process is present), the dot diameter is speedily expanded, and the dots are speedily saturated in comparison with a case where the plasma process is not applied (plasma process is absent). It is considered that this is because the viscosity of the ink is sufficiently thickened on the surface of the processing object due to the permeation of vehicles into the processing object and the cohesion of pigments on the surface of the processing object by applying the plasma process. On the other hand, in a case where the plasma process is not applied (plasma process is absent), the starting of the change of the dot diameter slowly occurs, and the change of the dot shape continues in 200 ms after the landing. It is considered that this is because the viscosity of the ink is not sufficiently thickened on the surface of the processing object.

Figure 20:
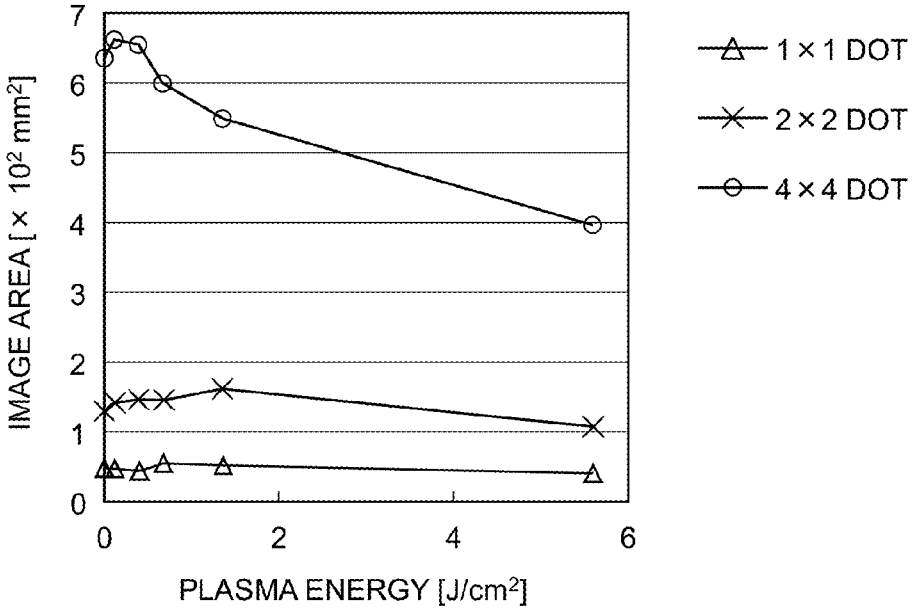
FIG. 20 is a graph illustrating a relationship between the plasma energy amount applied to the processing object according to the first embodiment and a change in image area of an ink dot.

Subsequently, a relationship between the plasma energy amount applied to the processing object and the change in image area of the ink dots will be described. FIG. 20 is a graph illustrating the relationship between the plasma energy amount applied to the processing object and the change in image area of the ink dots. FIG. 20 illustrates the image area in the case of printing the test pattern illustrated in FIG. 16. As illustrated in FIG. 20, in a case where the plasma energy amount is increased, the image area tends to be decreased. It is considered that this is because the effect of cohesion of pigments (the increase of the viscosity due to the cohesion) and the effect of permeability (the permeation of the vehicle into the coat layer) are improved as a result of the plasma process, so that the cohesion/permeation is speedily performed in the course of the dot spreading. The change of the shape is easy to detect if the pattern size is increased (pattern 4×4). It is considered that this is because the change of the image area is large if the pattern size is large (pattern 4×4). Therefore, by using this effect, it is possible to finely adjust the control of the plasma energy amount.

Subsequently, a printing apparatus, a printing system, and a method for manufacturing a printed material according to the first embodiment will be described in detail with reference to the drawings. In addition, in the first embodiment, an image forming device having ejection heads (recording heads, ink heads) of four colors of black (K), cyan (C), magenta (M), and yellow (Y) is described, but the invention is not limited to this ejection head. Namely, ejection heads corresponding to green (G), red (R), and other colors may be included, or only the ejection head of black (K) may be included. In the description hereinafter, K, C, M, and Y denote black, cyan, magenta, and yellow, respectively.

In the first embodiment, as the processing object, a continuous paper (hereinafter, referred to as a rolled paper) wound around a roll is used. However, the invention is not limited thereto, but for example, any recording medium where an image is able to be formed such as a cut paper may be used. In the case of a paper, as the type thereof, for example, a plain paper, a high quality paper, a recycled paper, a thin paper, a cardboard, a coated paper, or the like may be used. In addition, an OHP sheet, a synthetic resin film, a metal thin film, or any other products where an image is able to be formed by using an ink may also be used as the processing object. Herein, the rolled paper may be a continuous paper (a continuous account paper, a continuous account form) where cuttable perforations are formed at a predetermined interval. In this case, a page of the rolled paper denotes, for example, a region which is interposed between perforations at a predetermined interval.

Figure 21:
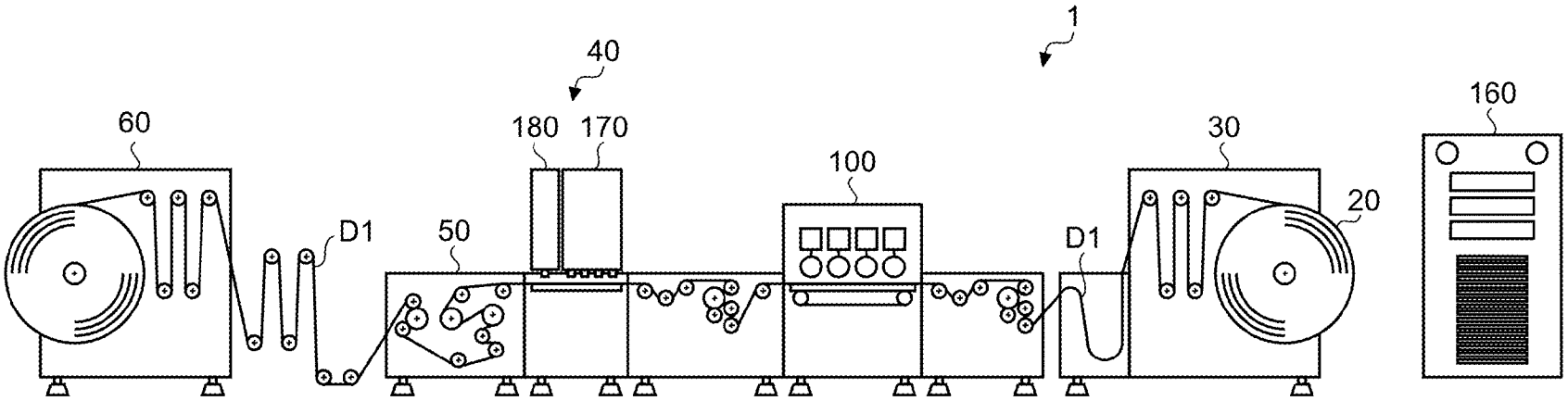
FIG. 21 is a schematic diagram illustrating a schematic configuration example of a printing apparatus (system) according to the first embodiment.

FIG. 21 is a schematic diagram illustrating an example of a schematic configuration of a printing apparatus (system) according to the first embodiment. As illustrated in FIG. 21, the printing apparatus (system) 1 is configured to include a carrying-in unit 30 which carries in (transports) the processing object 20 (rolled paper) along a transport path D1, a plasma processing device 100 which applies the plasma process as a pre-process on the carried-in processing object 20, and an image forming device 40 which forms an image on the surface of the processing object 20 which is applied with the plasma process. The above apparatus may be arranged in another casing and constitute a system as a whole or may be a printing apparatus accommodated in the same casing. The image forming device 40 may be configured to include an inkjet head 170 which forms the image on the processing object 20 which is applied with the plasma process through an inkjet process and a pattern reading unit 180 which reads the image formed on the processing object 20. The image forming device 40 may be configured to further include a post-processing unit which performs a post-process on the processing object 20 on which the image is formed. Furthermore, the printing apparatus (system) 1 may be configured to further include a drying unit 50 which dries the processing object 20 which is applied with the post-process and a carrying-out unit 60 which carries out the processing object 20 on which the image is formed (in some cases, the processing object which is further applied with the post-process). In addition, the pattern reading unit 180 may be installed at a downstream position from the drying unit 50 in the transport path D1. Furthermore, the printing apparatus (system) 1 may include a control unit 160 which generates raster data from the image data for printing or controls components of the printing apparatus (system) 1. The control unit 160 is able to communicate with the printing apparatus (system) 1 via a wired or wireless network. In addition, the control unit 160 needs not be configured with a single computer, but the control unit may be configured by connecting a plurality of computers via a network such as a LAN (Local Area Network). Furthermore, the control unit 160 may also have a configuration including control units which are separately installed in components of the printing apparatus (system) 1. In a case where the invention is configured as a printing system, the control unit 160 may be included in any apparatus.

Subsequently, the printing apparatus (system) 1 according to the first embodiment will be described more in detail. In the printing apparatus (system) 1, a pattern reading unit which acquires an image of formed dots is installed at the downstream side of an inkjet recording unit. By analyzing the acquired image, dot circularity, a dot diameter, a variation of concentration, and the like are calculated, and feedback control or feed forward control of the plasma processing unit is performed based on the result of the calculation.

Figure 22:
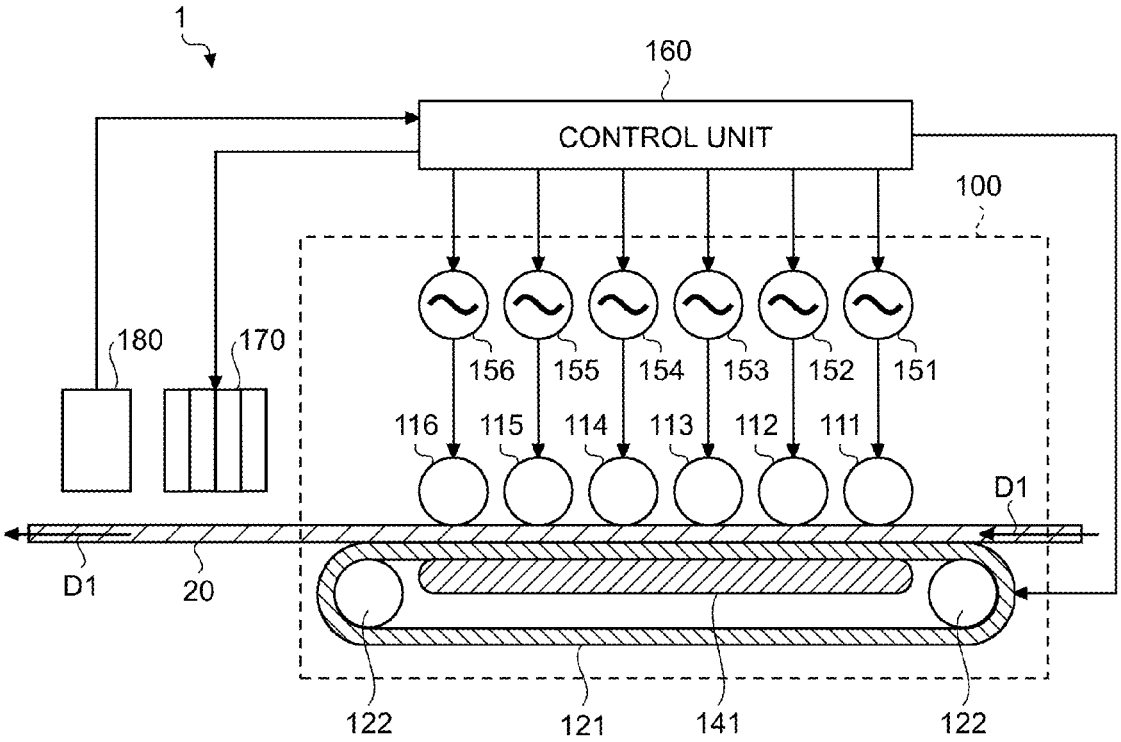
FIG. 22 is a schematic diagram illustrating a schematic configuration example of the printing apparatus (system) according to the first embodiment which includes a plasma processing device through a pattern reading unit arranged at the downstream side from an inkjet recording device.

FIG. 22 is a schematic diagram illustrating a schematic configuration example of the printing apparatus (system) 1 according to the first embodiment which includes a plasma processing device through a pattern reading unit arranged at the downstream side from an inkjet recording device. Other configurations are the same as those of the printing apparatus (system) 1 illustrated in FIG. 21, and thus, the detailed description thereof is omitted herein.

As illustrated in FIG. 22, a printing apparatus (system) 1 is configured to include a plasma processing device 100 arranged at the upstream side of a transport path D1, an inkjet head 170 arranged at the downstream side from the plasma processing device 100 in the transport path D1, a pattern reading unit 180 arranged at the downstream side from the inkjet head 170, and a control unit 160 controlling each component of the plasma processing device 100. The inkjet head 170 performs image formation by ejecting ink on the processing object 20 of which surface is plasma-processed by the plasma processing device 100 arranged at the upstream side. In addition, the inkjet head 170 may be controlled by a control unit (not illustrated) which is separately installed or may be controlled by the control unit 160.

The plasma processing device 100 is configured to include a plurality of discharging electrodes 111 to 116 which are arranged along a transport path D1, high-frequency high-voltage power supplies 151 to 156 which supply high frequency/high voltage pulse voltages to the respective discharging electrodes 111 to 116, a counter electrode 141 which is installed to be common to the discharging electrodes 111 to 116, a belt-conveyor-type endless dielectric material 121 which is arranged to flow along the transport path D1 between the discharging electrodes 111 to 116 and the counter electrode 141, and a roller 122. The processing object 20 is plasma-processed while being transported on the transport path D1. In the case of using a plurality of the discharging electrodes 111 to 116 arranged along the transport path D1, as illustrated in FIG. 22, an endless belt is very suitably used for the dielectric material 121.

The control unit 160 circulates the dielectric material 121 by driving the roller 122. When the processing object 20 is carried in on the dielectric material 121 from a carrying-in unit 30 (refer to FIG. 21) in the upstream, the processing object passes through the transport path D1 due to the circulation of the dielectric material 121.

The control unit 160 is able to separately turn on/off the high-frequency high-voltage power supplies 151 to 156. The high-frequency high-voltage power supplies 151 to 156 supply high frequency/high voltage pulse voltages to the discharging electrodes 111 to 116 according to a command from the control unit 160.

The pulse voltage may be supplied to all the discharging electrodes 111 to 116, or the pulse voltage may be supplied to a portion of the discharging electrodes 111 to 116. Namely, the pulse voltage may be supplied to the discharge electrode of which the number is required to allow the surface of the processing object 20 to have a predetermined pH value or less. The control unit 160 adjusts the frequency and the voltage value of the pulse voltage supplied from each of the high-frequency high-voltage power supplies 151 to 156, so that the plasma energy amount may be adjusted to a plasma energy amount required to allow the surface of the processing object 20 to have a predetermined pH value or less. In addition, for example, the control unit 160 may select the number of the driving high-frequency high-voltage power supplies 151 to 156 in proportion to print speed information or may adjust the intensity of the pulse voltage applied to each of the discharging electrodes 111 to 116. In addition, the control unit 160 may adjust the number of the driving high-frequency high-voltage power supplies 151 to 156 and/or the plasma energy amount applied to each the discharging electrodes 111 to 116 according to the type (for example, a coated paper, a PET film, or the like) of the processing object 20.

Herein, as a method of obtaining the plasma energy amount required to necessarily and sufficiently perform the plasma process on the surface of the processing object 20, a method of lengthening the time of the plasma process is considered. This is able to be implemented, for example, by slowing the transport speed of the processing object 20. However, in order to increase the throughput of the printing process, it is preferable that the time of the plasma process is shortened. As a method of shortening the time of the plasma process, as described above, a method of including discharging electrodes 111 to 116 and driving the discharging electrodes 111 to 116 of which the number is required according to the print speed or the required plasma energy amount or a method of adjusting the intensity of the plasma energy amount applied to the processing object 20 by each of the discharging electrodes 111 to 116 is considered. However, the invention is not limited thereto, but a method of combination thereof, other methods, or suitably modified methods may be available.

The configuration of including the plurality of the discharging electrodes 111 to 116 is effective in terms that the surface of the processing object 20 is uniformly plasma-processed. Namely, for example, in the case of the same transport speed (or print speed), in the case of performing the plasma process with the plurality of the discharging electrodes, the time of the processing object 20 passing through the plasma space is able to be lengthened in comparison with the case of performing the plasma process with one discharging electrode. As a result, it is possible to more uniformly apply the plasma process to the surface of the processing object 20.

In FIG. 22, for example, the pattern reading unit 180 images the dots of the image formed on the processing object 20. In the description hereinafter, the case of the dot pattern for analysis formed inside the image is exemplified.

The image acquired by the pattern reading unit 180 is input to the control unit 160. The control unit 160 analyzes the input image to the dot circularity, the dot diameter, the variation of concentration, and the like in the dot pattern for analysis and adjusts the number of the driving discharging electrodes 111 to 116 and/or the plasma energy amount of the pulse voltage applied to each of the discharging electrodes 111 to 116 from each of the high-frequency high-voltage power supplies 151 to 156 based on the result of the calculation.

As the inkjet head 170, a plurality of the same color heads (4 colors×4 heads) may be included. Accordingly, it is possible to implement a high speed inkjet recording process. At this time, for example, in order to achieve a resolution of 1200 dpi at a high speed, the heads of colors in the inkjet head 170 are fixed so as to be shift to correct the interval between the nozzles of injecting the ink. In addition, the head of each color is input with a driving pulse of a driving frequency having a few variations so that the dots of the ink ejected from the nozzle correspond to three types of amounts called large/medium/small droplets.

Figure 23:
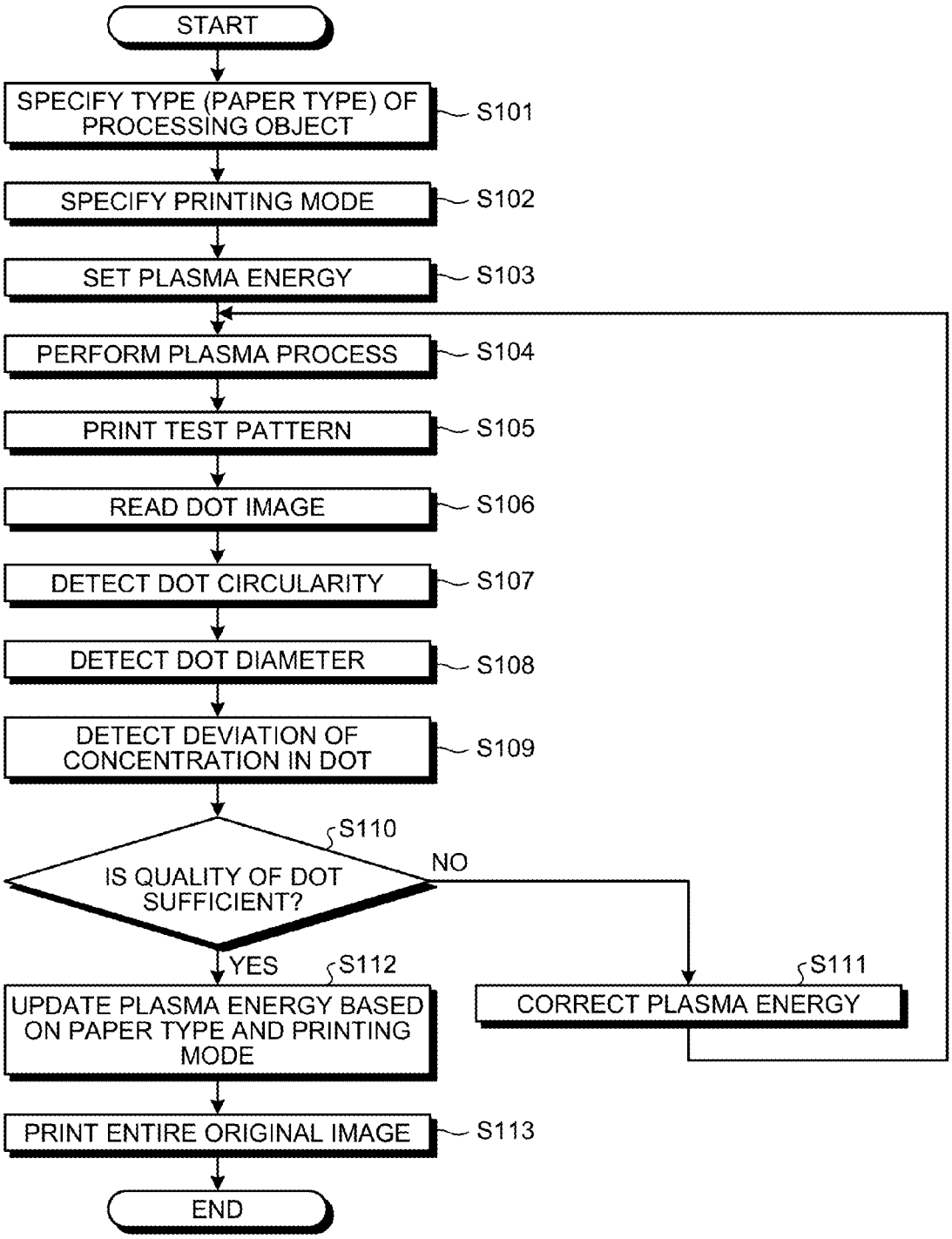
FIG. 23 is a flowchart illustrating an example of a printing process including the plasma process according to the first embodiment.

Subsequently, the printing process including the plasma process according to the first embodiment will be described in detail with reference to the drawings. FIG. 23 is a flowchart illustrating an example of the printing process including the plasma process according to the first embodiment. FIG. 24 is a diagram illustrating an example of a table used for specifying the ink droplet amount and the plasma energy amount in the flowchart illustrated in FIG. 23. FIG. 23 illustrates a flow of the printing process in the case of using the dot image illustrated in FIG. 16 as a test pattern. In FIG. 23, the case of printing a cut paper (recording medium cut in a predetermined size) as the processing object 20 by using the printing apparatus 1 illustrated in FIG. 22 is exemplified. However, the invention is not limited to the cut paper, and the same printing process may be applied to a rolled paper rolled around a roll.

As illustrated in FIG. 23, in the printing process, first, the control unit 160 specifies a type (paper type) of the processing object 20 (step S101). The type (paper type) of the processing object 20 may be set and input to the printing apparatus 1 by the user using a control panel (not illustrated). Otherwise, the printing apparatus 1 may include a paper type detection unit (not illustrated), and the control unit 160 may specify the type of the processing object based on paper type information detected by the paper type detection unit. In addition, for example, the paper type detection unit irradiates a surface of the paper with a laser beam and analyzes interference spectrum of reflected light to specify the type. Like this, various methods may be employed.

The control unit 160 specifies a printing mode (step S102). The printing mode is, for example, a resolution (600 dpi, 1200 dpi, or the like) of the image of the printed material. The printing mode may be set, for example, by the user using an input unit (not illustrated). Otherwise, the printing mode may be designated together with print data (raster data or the like) by an upper level apparatus (not illustrated). In addition, the printing mode may include designation of monochrome printing, color printing, or the like.

Next, the control unit 160 sets an interim plasma energy amount for the plasma process (step S103). The plasma energy amount may be specified from a table illustrated in FIG. 24 based on the specified type (paper type) of the processing object 20 and the specified printing mode. For example, in a case where the type of the processing object 20 is a coated paper A and the printing mode is 600 dpi, the control unit 160 sets the plasma energy to 1.4 J/cm$^2$. In addition, in the table illustrated in FIG. 24, the values of the plasma energy are registered, but the invention is not limited thereto. For example, the voltage values and the pulse time widths of the pulse voltages supplied to the discharging electrodes 111 to 116 by the high-frequency high-voltage power supplies 151 to 156 may be registered. In addition, in the table illustrated in FIG. 24, the plasma energy amount may be registered so as to be changed according to the monochrome printing mode and the color printing mode.

Next, the control unit 160 performs the plasma process on the processing object 20 by supplying appropriate pulse voltages from the high-frequency high-voltage power supplies 151 to 156 to the discharging electrodes 111 to 116 based the set plasma energy amount (step S104). Subsequently, the control unit 160 performs printing the test pattern on the after-plasma-process processing object 20 (step S105). In the printing of the test pattern, for example, a first-color solid image is printed as a base, and after that, a dot image illustrated in FIG. 16 is printed to be superimposed on the solid image. Subsequently, the control unit 160 images the dots of the test pattern by using the pattern reading unit 180 to read the image (dot image) of the second-color dots formed on the after-plasma-process processing object 20 (step S106).

Next, the control unit 160 detects the circularity (step S107) of the second-color dots, the dot diameter (step S108), and the deviation (variation, difference of concentration, or the like) (step S109) of concentration in the dot from the read dot image. However, in step S108, instead of the dot diameter, a dot area may be detected. The control unit 160 may determine a state of coalescence between the dots from the read dot image. The state of coalescence between the dots may be determined, for example, by pattern recognition.

Next, the control unit 160 determines based on the detected dot circularity, the detected dot diameter, and the detected deviation of concentration in the dot (the state of coalescence of the dots) whether or not the quality of the formed dots is sufficient (step S110). In a case where the quality is not sufficient (step S110; NO), the control unit 160 corrects the plasma energy amount according to the detected dot circularity, the detected dot diameter, and the detected deviation of concentration in the dot (the state of coalescence of the dots) (step S111) and returns to step S104 to perform the printing of the test pattern to the analyzing of the dots again. In the correction, for example, the set plasma energy amount may be increased or decreased by a predetermined correction value, or the plasma energy amount optimized according to the detected dot circularity, the detected dot diameter, and the detected deviation of concentration in the dot (the state of coalescence of the dots) may be obtained and the plasma energy amount may be set again to the obtained value.

On the other hand, in a case where the quality of the dots is sufficient (step S110; YES), the control unit 160 updates the plasma energy amount registered in FIG. 24 based on the specified type (paper type) of the processing object 20 and the specified printing mode (step S112), prints the entire original image as an actual printing object (step S113), and after completion, the operation is ended.

In addition, in the case of using a rolled paper as the processing object 20, in steps S104 to S111, a dot image formed after the plasma process may be acquired by using a distal portion of the paper guided by a paper feeding device (not illustrated). In the case of using the rolled paper, since the property and state are not almost changed in one roll, after the plasma energy amount is adjusted by using the distal portion, the setting is stabilized, and continuous printing is available. However, in a case where the rolled paper is not used and the device is stopped for a long time, since the property and state of the paper may be changed, it is preferable that, likewise before the resuming of the printing, the dot image formed after the plasma process is acquired again by using the distal portion and the analysis thereof is performed. After the dot image formed by using the distal portion after the plasma process is analyzed to adjust the plasma energy amount, the dot image may be periodically or continuously measured to adjust the plasma energy amount. Therefore, it is possible to perform more detailed stabilized control.

Figure 25:
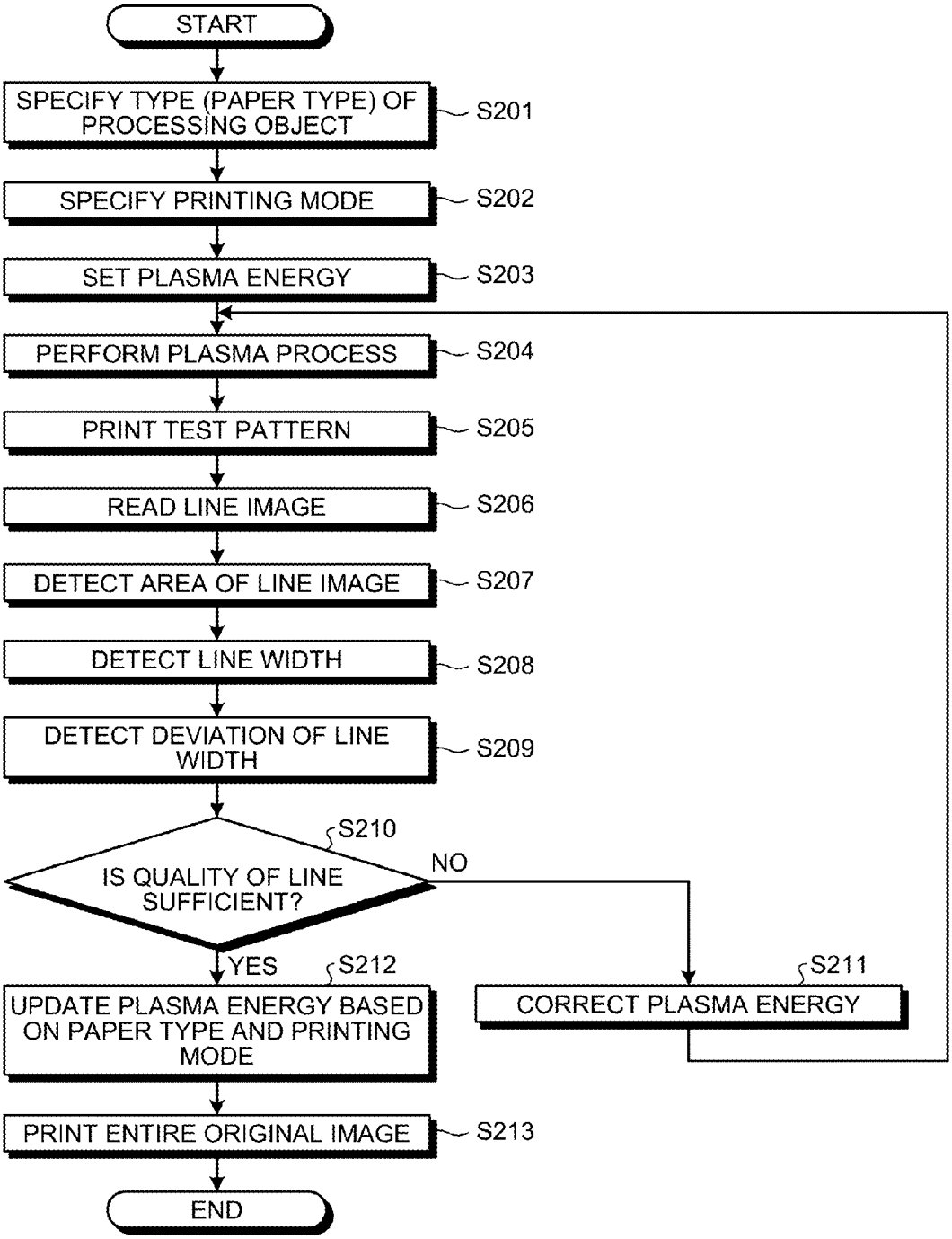
FIG. 25 is a flowchart illustrating another example of the printing process including the plasma process according to the first embodiment.

A printing process of the case of using a line image illustrated in FIG. 17 or 18 as a test pattern will be described. FIG. 25 is a flowchart illustrating a flow of the printing process of the case of using a dot image illustrated in FIG. 16 as a test pattern. In FIG. 25, similarly to FIG. 23, the case of printing a cut patter (recording medium cut in a predetermined size) as the processing object 20 by using the printing apparatus 1 illustrated in FIG. 22 is exemplified. However, the invention is not limited to the cut paper, but the same printing process may be applied to a rolled patter rolled around a roll.

In FIG. 25, the flow of steps S201 to S204 is the same as that of steps S101 to S104 in FIG. 23. After that, in FIG. 25, the control unit 160 performs printing the test pattern including a line image of the after-plasma-process processing object 20 (step S205). In the printing of the test pattern, for example, a first-color solid image is printed as a base, and after that, a line image illustrated in FIG. 17 or 18 is printed to be superimposed on the solid image. Subsequently, the control unit 160 images the lines of the test pattern by using the pattern reading unit 180 to read the image (line image) of the second-color lines formed on the after-plasma-process processing object 20 (step S206).

Next, the control unit 160 detects the area (step S207) of the second-color lines, the line width (step S208), and the deviation (variation) (step S209) of the line width from the read line image.

Next, the control unit 160 determines based on the detected line area, the detected line width, and the detected deviation of the line width whether or not the quality of the formed lines is sufficient (step S210). In a case where the quality is not sufficient (step S210; NO), the control unit 160 corrects the plasma energy amount according to the detected line area, the detected line width, and the detected deviation of the line width (step S211) and returns to step S204 to perform the printing of the test pattern to the analyzing of the lines again. In the correction, for example, the set plasma energy amount may be increased or decreased by a predetermined correction value, or the plasma energy amount optimized according to the detected line area, the detected line width, and the detected deviation of the line width may be obtained and the plasma energy amount may be set again to the obtained value.

On the other hand, in a case where the quality of the lines is sufficient (step S210; YES), the control unit 160 updates the plasma energy amount registered in FIG. 24 based on the specified type (paper type) of the processing object 20 and the specified printing mode (step S212), prints the entire original image as an actual printing object (step S213), and after completion, the operation is ended.

Heretofore, a case where the dots or lines are used as the test pattern is exemplified. However, the invention is not limited thereto, but the image may be formed by using other patterns and the read image read by capturing the formed image may be analyzed. In this case, a printed area or boundary length of the image for analysis may be detected to determine the quality.

In addition, in FIG. 23 or 25, the table illustrated in FIG. 24 is used. However, the invention is not limited to this method. For example, the initial plasma energy amount is set to a minimum value, and the operation is performed so that the plasma energy amount may be increased stepwise based on the result of analysis of the dot image or the line image of the obtained test pattern.

Figure 26:
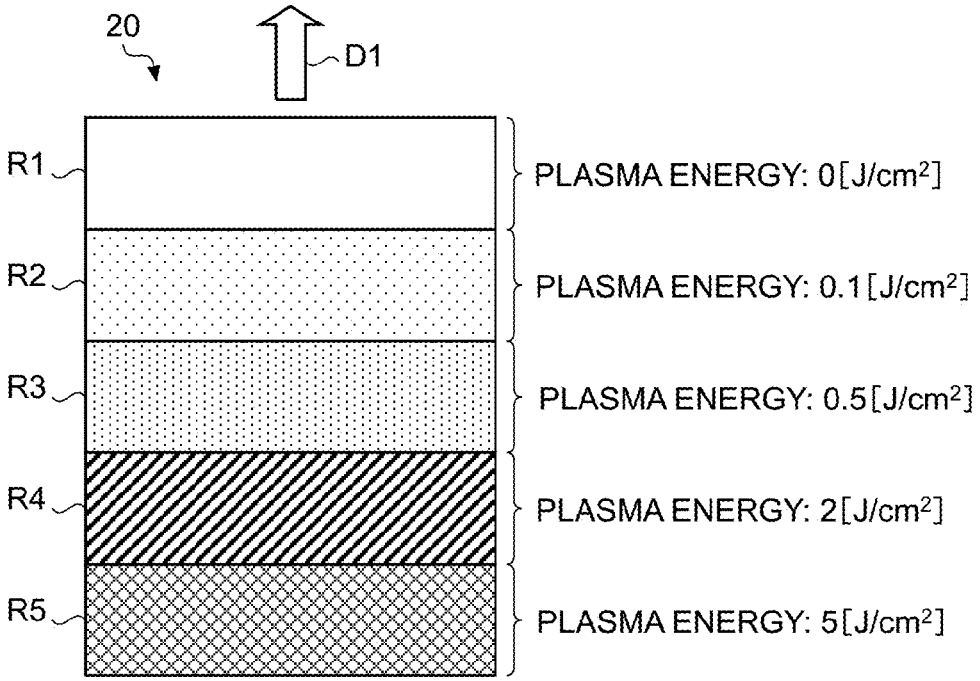
FIG. 26 is a diagram illustrating an example of a processing object where each area is applied with the plasma process using different plasma energy amount in the first embodiment.

In the case of specifying the optimal plasma energy amount by increasing the plasma energy amount from the minimum value stepwise, the plasma energy amount which is applied to the discharging electrodes 111 to 116 in FIG. 22 may be changed so as to be increased from the downstream side stepwise, and the transport speed of the processing object 20, that is, the circulation speed of the dielectric material 121 may be changed. As a result, in step S104 of FIG. 23 (or step S204 of FIG. 25), as illustrated in FIG. 26, it is possible to obtain the processing object 20 which is plasma-processed with different plasma energy amounts for different regions. In FIG. 26, a region R1 is a region (plasma energy=0 J/cm$^2$) which is not plasma-processed, a region R2 represents a region which is plasma-processed with the plasma energy of 0.1 J/cm$^2$, a region R3 represents a region which is plasma-processed with the plasma energy of 0.5 J/cm$^2$, a region R4 represents a region which is plasma-processed with the plasma energy of 2 J/cm$^2$, and a region R5 represents a region which is plasma-processed with the plasma energy of 5 J/cm$^2$.

Figure 27:
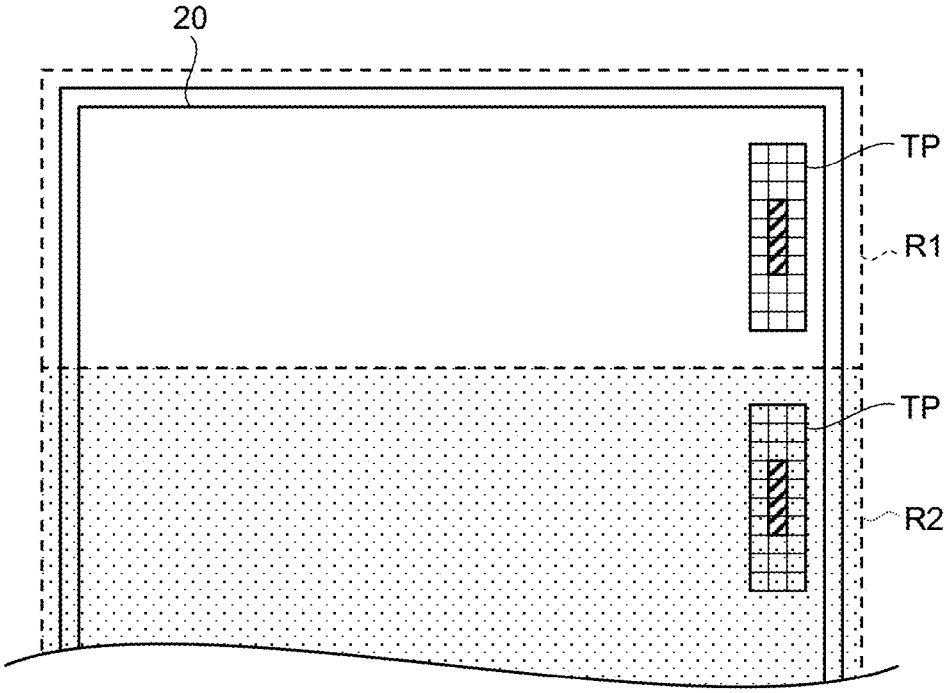
FIG. 27 is a diagram illustrating a test pattern formed with respect to the processing object illustrated in FIG. 26.

In the processing object 20 which is plasma-processed with different plasma energy amounts for different regions as illustrated in FIG. 26, for example, a test pattern TP illustrated in FIG. 27 may be formed in each of the regions R1 to R5 in step S105 of FIG. 23 (or step S205 of FIG. 25). Herein, as the test pattern TP, an example where second-color dots of cyan are formed on the first-color dots of yellow (solid image) is illustrated, and the second-color dots may be magenta or black. The first-color dots (solid image) may be of colors other than yellow. Particularly, in film media, since there is a case of using a white ink besides CMYK inks, the white ink may be used for the first-color dots. In addition, in a case where the user checks the result of printing of the test pattern, the first-color dots (solid image) of the test pattern are preferably formed by using a high luminosity ink such as yellow or white, and the second-color dots of the image for analysis are preferably formed by using a low luminosity ink such cyan, magenta, or black.

Figure 28:
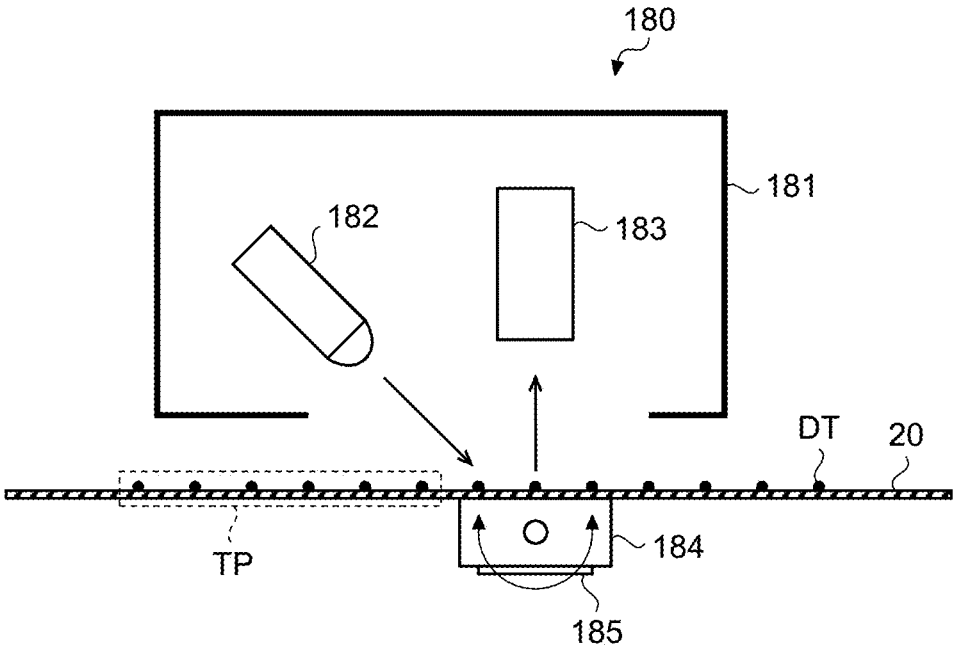
FIG. 28 is a schematic diagram illustrating an example of the pattern reading unit according to the first embodiment.

Next, the pattern reading unit 180 according to the first embodiment will be described. FIG. 28 is a schematic diagram illustrating an example of the pattern reading unit according to the first embodiment. As illustrated in FIG. 28, in the pattern reading unit 180, for example, a reflection type two-dimensional sensor including a light emitting unit 182 and a light receiving unit 183 is used. The light emitting unit 182 and the light receiving unit 183 are arranged, for example, inside a case 181 arranged at the dot formation side with respect to the processing object 20. An opening is installed at the processing object 20 side of the case 181, and the light emitted from the light emitting unit 182 is reflected on the surface of the processing object 20 to be incident on the light receiving unit 183. The light receiving unit 183 focuses a reflected light amount (reflected light intensity) reflected on the surface of the processing object 20. Since the light amount (intensity) of the focused reflected light is varied among the portion where there is a printed character (dots DT of the test pattern TP) and the portion where there is no printed character, it is possible to detect the dot shape and the image density inside the dots based on the reflected light amount (reflected light intensity) detected by the light receiving unit 183. In addition, the configuration of the pattern reading unit 180 or the detection method thereof may be variously modified, for example, as a method of detecting by reading with a color CCD camera if the test pattern TP printed on the processing object 20 is able to be detected.

Figure 29:
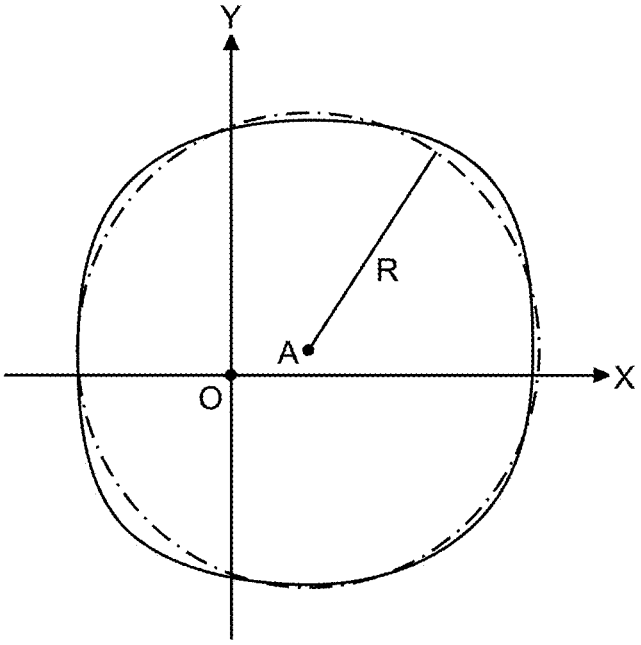
FIG. 29 is a diagram illustrating an example of a captured image (dot image) of dots acquired in the first embodiment.

Next, an example of a method of determining a dot size of the test pattern formed on the processing object 20 will be described with reference to the drawings. In the determination of the dot size of the dot pattern for analysis, by imaging the dot pattern for analysis recorded on the after-plasma-process processing object 20 together with a reference pattern 185 by using the pattern reading unit 180, the captured image (dot image) of the dots illustrated in FIG. 29 is acquired.

In addition, it is checked through measurement in advance which one of the positions of the entire captured image of the light receiving unit 183 (the entire captured region of the two-dimensional sensor) illustrated in FIG. 28 the position of the reference pattern 185 is. The control unit 160 performs calibration on the dot image for analysis by comparing the pixels of the acquired dot pattern for analysis image with the pixels of the dot image of the reference pattern 185. At this time, for example, as illustrated in FIG. 29, there is a circle-like figure (for example, an outline of the dot for analysis: solid line) which is not a perfect circle, and the circle-like figure is fitted to the perfect circle (an outline of the dot of the reference pattern 185: dot-dashed line). In the fitting, a least square method is used.

Figure 30:
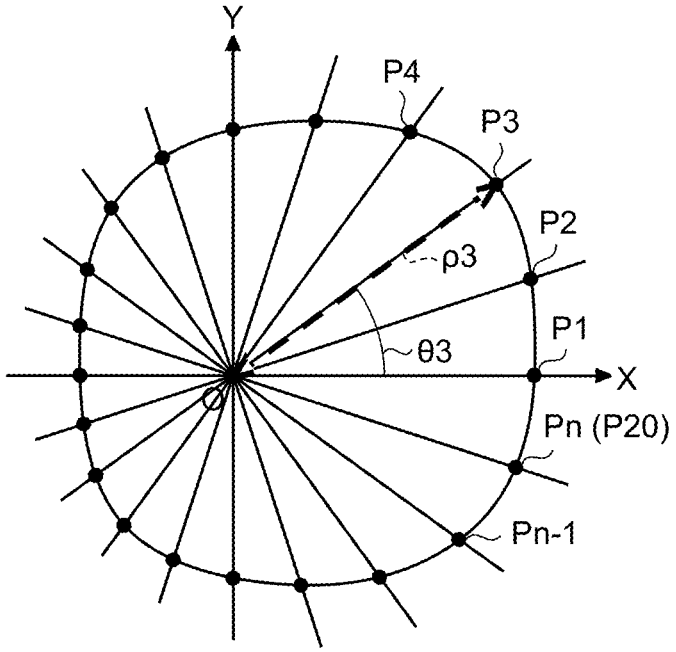
FIG. 30 is a diagram illustrating a flow in the case of applying a least square method to the captured image illustrated in FIG. 29.

As illustrated in FIG. 30, in the least square method, in order to numeralize the deviation between the circle-like figure (solid line) and the perfect circle (dot-dashed line), a rough center position is taken as the origin O, an XY coordinate system is set on the basis of the origin O, and finally, the optimal center point A (coordinate (a, b)) and the radius R of the perfect circle are obtained. Therefore, first, the one circumference ($2\pi$) of the circle-like figure is equally divided based on angles, and with respect to the data points P1 to Pn obtained in the division, angles $\theta$ with respect to the X axis and distances $\rho i$ from the origin O are obtained. Herein, the number of data points (namely, the number of date sets) is set to 'N', the following Formula (1) may be derived from a relationship of trigonometric functions.

$$x_i = \rho_i \cos\theta_i$$

$$y_i = \rho_i \cos\theta_i \tag{1}$$

At this time, the optimal center point A (coordinate (a, b)) and the radius R of the perfect circle are given by the following Formula (2).

$$R = \frac{\sum_{i=1}^{N} \rho_i}{N}$$

$$a = \frac{2\sum_{i=1}^{N} x_i}{N} \tag{2}$$

$$b = \frac{2\sum_{i=1}^{N} y_i}{N}$$

In this manner, by reading the dot image of the reference pattern 185 and comparing the diameter of the dot diameter calculated by the above-described least square method with the diameter of the reference chart, the calibration is performed. After the calibration, by reading the dot image printed in the pattern, the dot diameter is calculated.

In addition, a circle-like figure is disposed between two concentric geometric circles and the interval between the concentric circles becomes minimized, the circularity is generally defined as a difference between the radii of the two concentric circles. However, a ratio of minimum diameter/maximum diameter in the concentric circle may also be defined as the circularity. In this case, a case where the value of minimum diameter/maximum diameter is '1' denotes a perfect circle. The circularity is also calculated by acquiring the dot image and using the least square method.

The maximum diameter may be obtained as the maximum distance when the dot center and the points on the circumference of the dot in the acquired image are connected. On the other hand, similarly, the minimum diameter may be calculated as the minimum distance when the dots center point and the points on the circumstance of the dot are connected.

The dot diameter and the dot circularity are different depending on the ink permeated state of the processing object 20. In the first embodiment, the quality of the image is improved by controlling the dot shape (circularity) or the dot diameter as to be target values according to the type of the processing object 20 or the ink ejection amount. In the first embodiment, in order to obtain the high image quality, the formed image is read, the image is analyzed, and the plasma energy amount in the plasma process is adjusted so that the dot diameter for each ink ejection amount becomes a target dot diameter.

In the first embodiment, since the concentration of pigments in the dot is able to be detected based on the light amount of the reflected light, the dot image is acquired, and the concentration in the dot is measured. By calculating the concentration value as a variation variance in statistical calculation, the irregularity of concentration is measured. In addition, by selecting the plasma energy amount so that the calculated irregularity of concentration becomes minimized, it is possible to prevent mixture of pigments caused by the coalescence of the dots, so that the high image quality is able to be newly obtained. Which one of the controls of the dot diameter, the suppression of the irregularity of concentration, and the improvement of the circularity is to be preferentially performed may be selected by the user switching the mode according to a favorite image quality.

In a case where the read image is a line image (step S206 of FIG. 25), the image area is able to be calculated from the number of pixels forming the line image. The line width and the deviation (variation) of the line width may be measured, for example, by using a measurement method in Japanese Industrial Standard JIS-X6930. Accordingly, by selecting the plasma energy amount so that the image area or the line width of the line image becomes a target value, it is possible to obtain the same effect as that of the above-described case of using the dot image. Otherwise, by selecting the plasma energy amount so that the deviation of the line width is minimized, it is also possible to obtain the same effect.

In this manner, in the first embodiment, the plasma energy amount is controlled so that the dot circularity, the irregularity of pigments in the dot, the deviation of the line width, or the like becomes small or so that the dot diameter, the line width, the image area, or the like has a target size. Accordingly, it is possible to provide a printed product having a high image quality without use of a pre-coating liquid. Furthermore, even in a case where the property or state of the processing object is changed or the print speed is changed, since the stabilized plasma process is able to be performed, it is possible to implement stabilized good image recording.

In the above-described first embodiment, a case where the plasma process is performed mainly on the processing object is described. However, as described above, if the plasma process is performed, the wettability of the ink with respect to the processing object is improved. As a result, since the dots attached during the inkjet recording are spread, there is a possibility that an image different from that of a case where the image is developed is recorded on the processing object which is not processed. In this case, when performing printing on the recording medium which is plasma-processed, the ink droplet amount is reduced by decreasing the ink ejection voltage at the time of performing the inkjet recording, so that it is possible to suppress the image different from that of a case where the image is developed from being recorded in the processing object which is not processed. Furthermore, as a result of the decrease of the ejection voltage, since the ink droplet amount or the driving voltage is able to be reduced, it is also possible to reduce a print cost.

Figure 31:
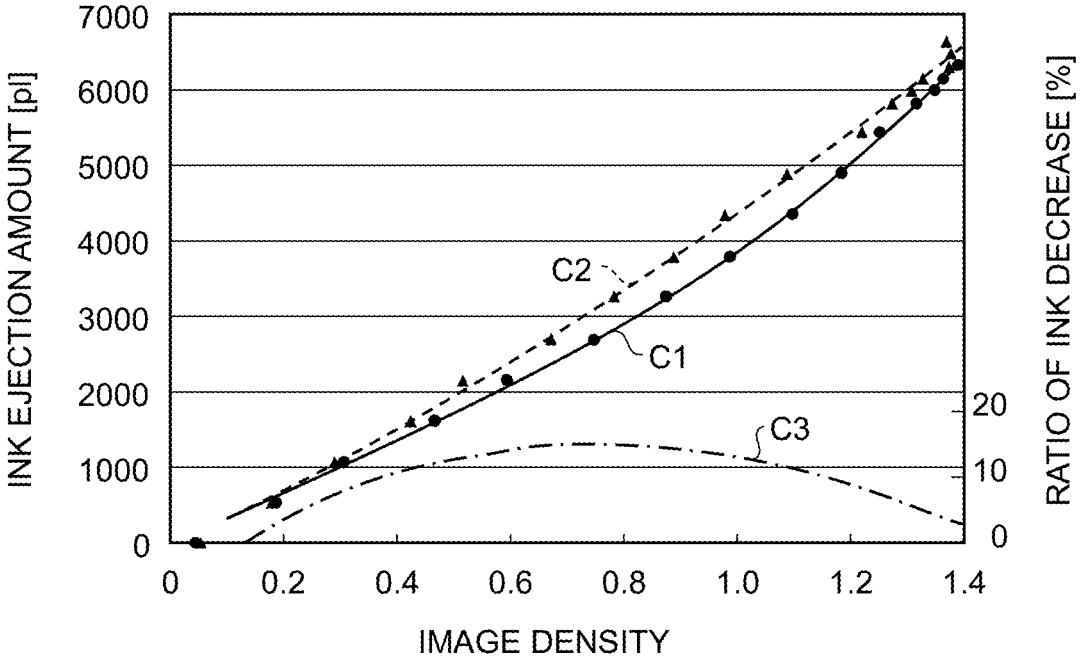
FIG. 31 is a graph illustrating a relationship between an ink ejection amount and an image density according to the first embodiment.

Herein, a relationship between the ink ejection amount and the image density will be described. FIG. 31 is a graph illustrating the relationship between the ink ejection amount and the image density. In FIG. 31, a solid line C1 represents a relationship between the ink ejection amount and the image density when the inkjet recording process is performed on the processing object which is not applied with the above-described plasma process according to the first embodiment, and a broken line C2 represents a relationship between the ink ejection amount and the image density when the inkjet recording process is performed on the processing object which is applied with the above-described plasma process according to the first embodiment. A dot-dashed line C3 represents a ratio of ink decrease of the broken line C2 to the solid line C1.

As can be understood from the comparison between the solid line C1 and the broken line C2 and the dot-dashed line C3 in FIG. 31, the above-described plasma process according to the first embodiment is applied on the processing object 20 before the inkjet recording process, so that the ink ejection amount required to obtain the same image density is reduced due to the effects such as the improvement of the dot circularity, the expansion of the dot, the uniform concentration of pigments in the dot, and the like.

Furthermore, the above-described plasma process according to the first embodiment is applied on the processing object 20 before the inkjet recording process, and thus, the thickness of the pigments attached on the processing object 20 becomes small, so that it is possible to obtain the effects of the improvement of saturation and the spreading of the color gamut. Furthermore, as a result of the decrease of the ink amount, the drying energy of the ink is able to be reduced, so that it is possible to obtain the effect of the energy saving.

In the above-described first embodiment, the example of analyzing the dots or lines of the second color ink of the second color image is exemplified. However, a third color image or a furthermore-superimposed image may be analyzed. It is considered that there is an ideal pH value at which the wettability or the permeability of each processing object is improved according to the component or type of the ink, a change of the processing object, or the like. Therefore, the plasma energy amount or the target pH value as an optimal condition for each type of the ink or each type of the processing object may be obtained in advance, and the value may be registered in the control unit. The user may check the test pattern and directly set the plasma energy amount by using an appropriate input unit. With respect to the timing of analyzing the image, the image analyzing may be performed before the image formation as a printing job, the image analyzing may be performed every certain time such as during a job or between jobs, or the image analyzing may be performed arbitrarily by the user. In addition, before the inkjet recording process, the discharged plasma which is formed by ionizing the ambient gas through discharging may be configured to be performed on the surface of the printed material. In this manner, since the wettability of the surface of the processing object is improved by applying the hydrophilic process on the surface of the printed material before the inkjet recording process, it is possible to improve the circularity of the dots formed through the inkjet recording process. Furthermore, since the drying time of the vehicle is able to be shortened, it is possible to reduce the occurrence of the beading.

Second Embodiment

Next, a printing apparatus, a printing system, and a method for manufacturing a printed material according to a second embodiment of the present invention will be described in detail with reference to the drawings. In the description hereinafter, the same configurations and operations as those of the first embodiment are denoted by the same reference numerals, and redundant description thereof will be omitted.

In the first embodiment, the test pattern is printed before the image of the actual printing object is printed, and the plasma energy amount is adjusted based on the result of the analysis of the dot image or the line image obtained from the printed test pattern. On the contrary, in the second embodiment, a portion of the image of the actual printing object is used as the test pattern, and the plasma energy amount is adjusted based on the result of the analysis of the captured image.

Similarly to the test pattern used in the first embodiment, a portion of a print-object image which is to be used as the test pattern may be a portion of an area where the second-color ink dot is formed to be superimposed on or adjacent to the first-color ink dot. Therefore, similarly to the first embodiment, by detecting the shape change of the second-color ink dot which is relatively easily detected and adjusting a plasma energy amount in a plasma process based on the detection result, it is possible to more appropriately control wettability of the surface of the processing object which is applied with the plasma process and cohesiveness or permeability of ink pigments caused by a decrease in a pH value. As a result, the coalescence of ink dots is prevented, so that it is possible to expand sharpness of dots or color gamut. Therefore, image defects such as beading or bleed are solved, so that it is possible to obtain a printed material where a high-quality image is formed. Furthermore, since a thickness of cohered pigments on the surface of the processing object is small and uniform, the ink droplet amount is reduced, so that it is possible to reduce ink drying energy and to reduce a print cost.

The printing apparatus (system) according to the second embodiment may have the same configuration as that of the printing apparatus (system) 1 exemplified in the first embodiment. However, in the second embodiment, the printing process including the plasma process is as follows.

Figure 32:
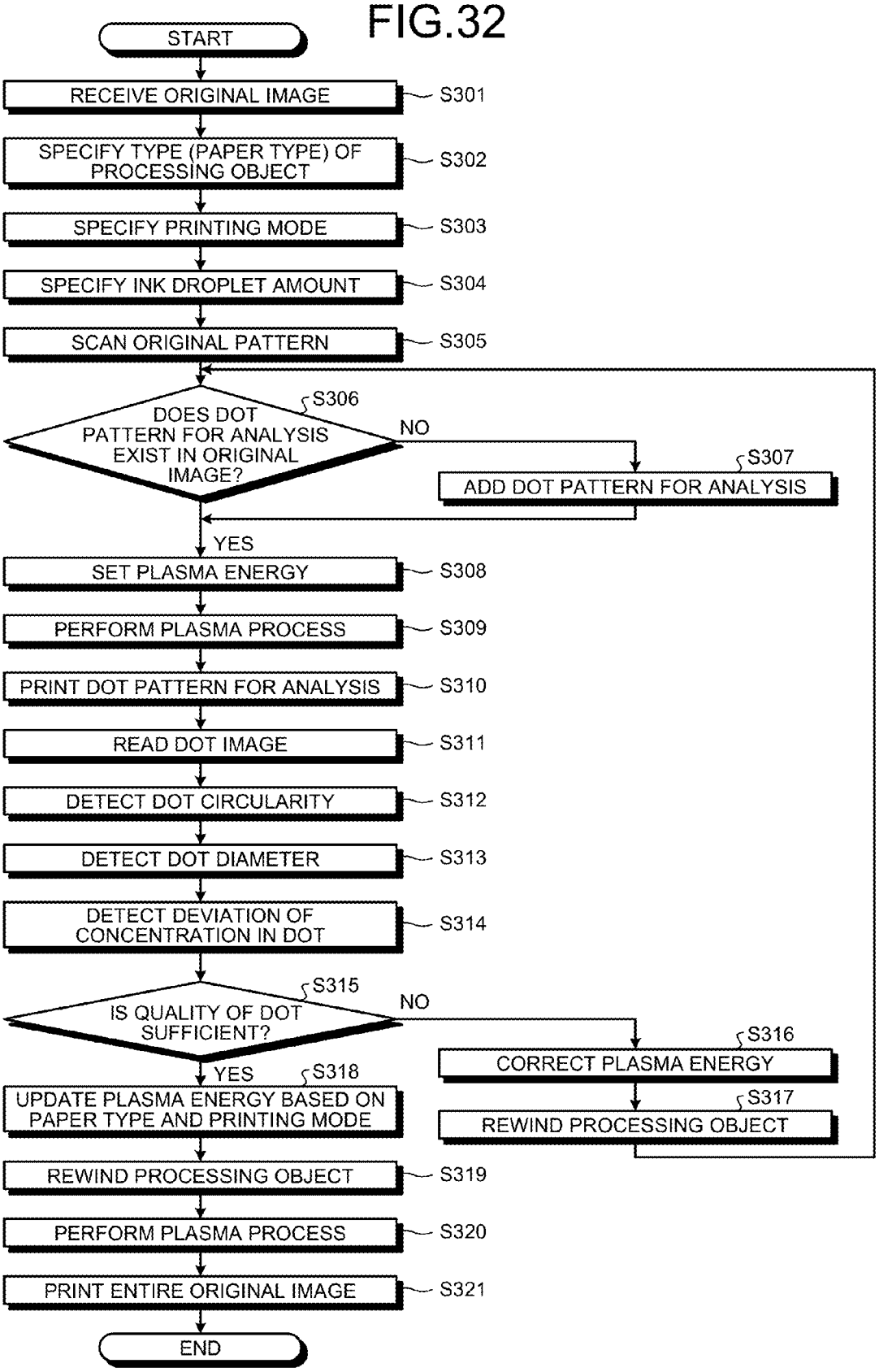
FIG. 32 is a flowchart illustrating an example of a printing process including a plasma process according to the second embodiment.

FIG. 32 is a flowchart illustrating an example of the printing process including the plasma process according to the second embodiment. FIG. 33 is a diagram illustrating an example of a table used for specifying an ink droplet amount and a plasma energy amount in the flowchart illustrated in FIG. 32. In addition, in FIG. 32, the case of printing a cut paper (recording medium cut in a predetermined size) as the processing object 20 by using the printing apparatus (system) 1 exemplified in FIG. 22 in the first embodiment is exemplified. However, the invention is not limited to the cut paper, and the same printing process may be applied to a rolled paper rolled around a roll.

As illustrated FIG. 32, in the printing process, first, the control unit 160 receives an original image (for example, raster data or the like) (step S301). Next, similarly to steps S101 and S102 of FIG. 23, the control unit 160 specifies a type (paper type) of the processing object 20 (step S302) and specifies a printing mode (step S303).

Next, the control unit 160 specifies an ink droplet amount at the time of printing an original image (step S304). The ink droplet amount may be, for example, specified in the table illustrated in FIG. 33 based on the specified printing mode and the dot size. For example, in a case where the printing mode is 1200 dpi and the dot size is a small droplet, the ink droplet amount may be specified as 2 pL (pico liters) based on the table illustrated in FIG. 33. In a case where the printing mode is 600 dpi and the dot size is a large droplet, the ink droplet amount may be specified as 15 pL (pico liters). The dot size is a size of the liquid droplet ejected from the inkjet head 170 or a size of the dot formed on the processing object 20. The dot size may be specified from the image information of the printing object by the control unit 160.

Next, the control unit 160 scans the original image (step S305), and determines based on the result of the scanning whether or not the dot pattern for analysis which is able to be used as the test pattern exists in the original image (step S306). The dot pattern for analysis which is able to be used as the test pattern will be exemplified in the later description.

As a result of the determination of step S306, in a case where the dot pattern for analysis which is able to be used as the test pattern on the original image exists (step S306; YES), the control unit 160 proceeds to step S308. On the other hand, in a case where the dot pattern for analyses which is able to be used as the test pattern on the original image does not exist (step S306; NO), the control unit 160 newly adds the dot pattern for analysis to the original image (step S307), and after that, the control unit proceeds to step S308. The determination and addition of the dot pattern for analysis which is able to be used as the test pattern will be described later in detail.

In step S308, the control unit 160 sets a temporal plasma energy amount at the time of the plasma process (step S308). The plasma energy amount is able to be specified in the table illustrated in FIG. 33 based on the specified type (paper type) of the processing object 20 and the specified ink droplet amount. For example, in a case where the type of the processing object 20 is a coated paper A, the resolution is 1200 dpi, and the ink droplet amount is 6 pL of large droplets, the control unit 160 sets the plasma energy amount to 0.7 J/cm$^2$. However, a case where the type (hereinafter, referred to as a droplet type) of the ink droplet amount in the printing process is single is very rare, but generally the small droplets, the medium droplets, and the large droplets exist to be mixed. Therefore, in a case where the droplet types in the printing process exist to be mixed, the plasma energy amount may be set based on the ink droplet amount requiring the most plasma energy amount used for forming the image. In this case, for example, in a case where the small droplets, the medium droplets, and the large droplets exist to be mixed as the droplet types used for forming the image, the energy setting of the large droplets is used, and in the case of the small droplets and the medium droplets, the energy setting of the medium droplets is used. In the table illustrated in FIG. 33, the values of the plasma energy amount temporarily used for the determination are registered. However, the invention is not limited thereto, but for example, the voltage values of the pulse voltages supplied from the high-frequency high-voltage power supplies 151 to 156 to the discharging electrodes 111 to 116 and the time widths of the pulses may be registered. In the table illustrated in FIG. 33, the plasma energy amount may also be changed and registered according to the monochrome printing mode and the color printing mode.

Next, the control unit 160 performs the plasma process on the processing object 20 by supplying appropriate pulse voltages from the high-frequency high-voltage power supplies 151 to 156 to the discharging electrodes 111 to 116 based on the set plasma energy amount (step S309). Herein, the range where the plasma process is performed may include the range where the dot pattern for analysis is formed. Subsequently, the control unit 160 prints the region including the dot pattern for analysis of the original image with respect to the region where the plasma process is applied to the processing object 20 (step S310).

Next, the control unit 160 determines by performing the processes of steps S106 to S110 of FIG. 23 whether or not the quality of the dot of the dot pattern for analysis in the dot image which is read by the pattern reading unit 180 is sufficient (steps S311 to S315).

As a result of the determination of step S315, in a case where the quality of the dot is not sufficient (step S315; NO), similarly to step S111 of FIG. 23, the control unit 160 corrects the plasma energy amount according to the detected dot circularity, the detected dot diameter, and the deviation of concentration in the dot (the state of coalescence of the dots) (step S316). The control unit 160 rewinds the processing object 20 (step S317) and returns to step S306. However, in the case of returning to step S306, since the performing of a partial plasma process and the forming of a partial image are already finished in the flow up to the foregoing time, after returning to step S306, the plasma process and the image forming may be performed from a region which is later than the region where the plasma process and the image forming are performed in the flow up to the foregoing time. In this case, step S317 may be omitted.

On the other hand, in a case where the quality of the dot for analysis is sufficient (step S315; YES), the control unit 160 updates the plasma energy amount registered in FIG. 33 based on the specified type (paper type) of the processing object 20 and the specified printing mode (step S318), rewinds the processing object 20 (step S319), processes the entire surface of the processing object 20 with the set plasma energy amount (step S320), prints the entire original image of the actual printing object (step S321), and after completion, the printing operation is ended. The rewinding of the processing object 20 in step S319 may be omitted.

As illustrated in FIG. 32, in a case where a rolled paper is used as the processing object 20, the property and state are not almost changed by the one roll. Therefore, after the plasma energy amount is adjusted by using an upstream portion of the original image, the continuous printing is able to be performed without change of the setting. However, in a case where the rolled paper is not used and the device is stopped for a long time, the property and state of the paper may be changed. In this case, likewise before the resuming of the printing, the dot image is acquired again by using the upstream portion of the original image, and the dot image may be analyzed to adjust the plasma energy amount. After the plasma energy amount is first adjusted by using the upstream portion of the original image, the dot image may periodically or continuously be measured to adjust the plasma energy amount. Therefore, it is possible to perform more detailed stabilized control.

In a case where a plurality of the dot patterns for analysis which is able to be used as the test pattern exist, the dot patterns for analysis printed as the actual test pattern in step S310 are preferably the dot patterns which are located at the most upstream position of the original image. Furthermore, the dot pattern for analysis printed as the actual test pattern is preferably located in the vicinity of the relatively distal portion (for example, within several centimeters in the distal page of the original image). In a case where the dot pattern for analysis which is able to be used as the actual test pattern does not exist in the vicinity of the relatively distal portion of the original image, for example, in step S306, it is determined that the dot pattern for analysis which is able to be used as the test pattern does not exist on the original image (step S306; NO), in step S307, the dot pattern for analysis may be newly added to the relatively distal portion of the original image. In addition, the determination whether or not to be in the vicinity of the relatively distal portion is, for example, able to be implemented by a configuration where a threshold value is provided in a dot pattern searching range.

Furthermore, the rewinding of the processing object 20 in steps S317 and S319 are effective in a case where the distance from the plasma process position to the inkjet recording position and the pattern reading position is large. In a case where the distance is large, if the rewinding of the processing object 20 is not performed and the loop passing through NO of step S315 is repeated many times, many processing objects 20 which are consumed but not used for the determination of the dot quality or the actual printing process occur. Therefore, in steps S309 and S310, after the plasma process on the region including the dot pattern for analysis in the original image and the analysis process for the image obtained by performing the plasma process are performed, the processing object 20 is rewound in step S317 or S319, so that it is possible to reduce the region of the processing object 20 which is consumed but not used for the determination of the dot quality or the actual printing process.

Next, a specific example of the dot pattern for analysis which is able to be used as the test pattern will be exemplified and described hereinafter. In the description hereinafter, the first-color ink is to be cyan (C), and the second-color ink is set to be yellow (Y).

Figure 17:
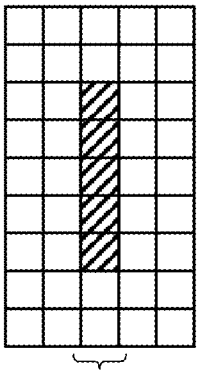
FIG. 17 is a diagram illustrating an example of a line pattern as a test pattern exemplified in the first embodiment.
Figure 18:
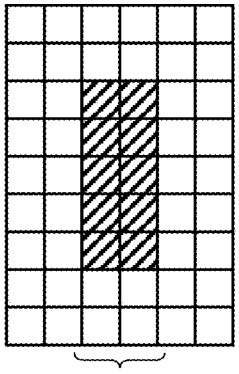
FIG. 18 is a diagram illustrating another example of a line pattern as a test pattern exemplified in the first embodiment.
Figure 34:
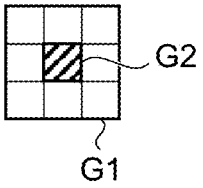
FIG. 34 is a diagram illustrating an example of a dot pattern for analysis which is able to be used as a test pattern in the second embodiment.
Figure 35:
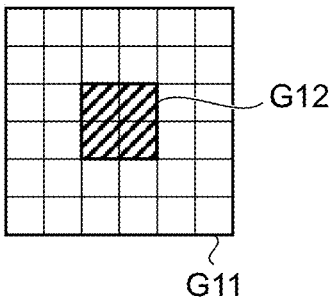
FIG. 35 is a diagram illustrating another example of a dot pattern for analysis which is able to be used as a test pattern in the second embodiment.

As the dot pattern for analysis which is able to be used as the test pattern, as illustrated in FIGS. 16 to 18, a partial image where a second-color m×n dot pattern or line pattern (m and n are integers) is arranged on the first-color solid image may be used. In addition, by considering the influence of the bleeding of the second-color dots, the first-color solid image is preferably formed in a range which is sufficiently wider than that of the second-color dot/line pattern. For example, as illustrated in FIG. 34, in a case where the second-color dot pattern G2 has 1×1 dots, the first-color solid image G1 is preferably a 3×3 solid image G1 having a margin of at least one dot around the second-color dot pattern G2. For example, as illustrated in FIG. 35, in a case where the second-color dot pattern G12 has 2×2 dots, the first-color solid image G11 is preferably a 6×6 solid image G11 having a margin of at least two dots around the second-color dot pattern G2.

Figure 36:
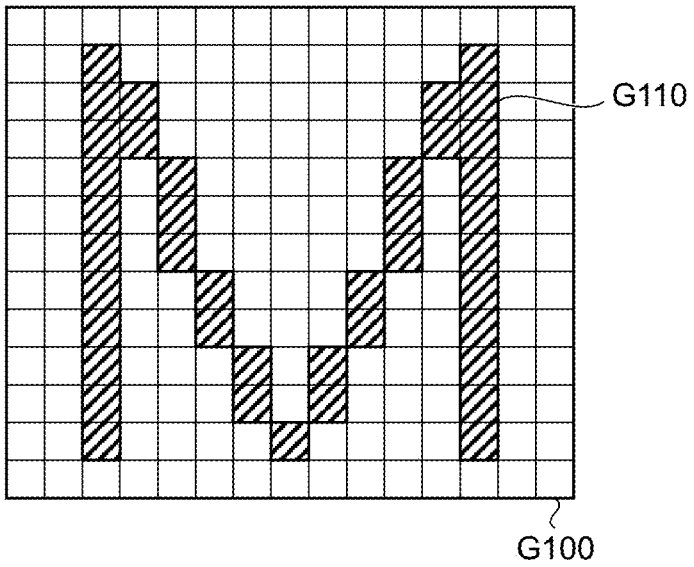
FIG. 36 is a diagram illustrating an example of a dot arrangement pattern in a case where a character (M) is formed as a second-color dot pattern on a first-color solid image.

As the dot pattern for analysis, a dot pattern of the image forming process may be used. FIG. 36 is a diagram illustrating an example of a dot arrangement pattern in a case where a character (M) is formed as a second-color dot pattern G110 on a first-color solid image G100. FIGS. 37A, 37B, 37C, and 37D are diagrams illustrating beginning processes of forming the dot arrangement pattern illustrated in FIG. 36.

Figure 37A:
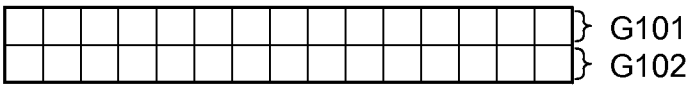
FIGS. 37A, 37B, 37C, and 37D are diagrams illustrating beginning processes of forming the dot arrangement pattern illustrated in FIG. 36.
Figure 37B:
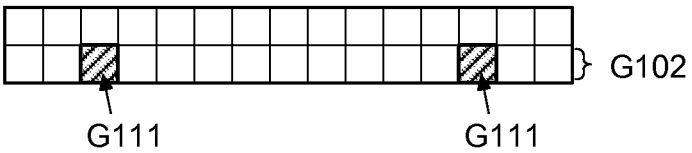
Figure 37C:
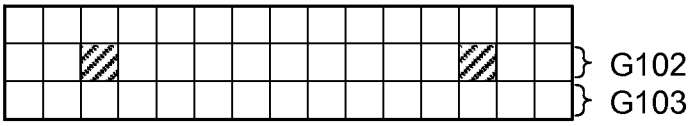
Figure 37D:
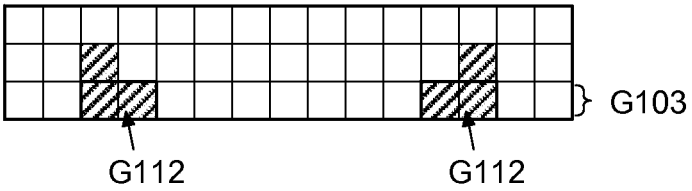

As illustrated in FIGS. 37A, 37B, 37C, and 37D, the dot arrangement pattern illustrated in FIG. 36 is formed with dot rows in the figures. More specifically, first, as illustrated in FIG. 37A, a first dot line G101 and a second dot line G102 of a first-color solid image G100 are sequentially formed. Subsequently, as illustrated in FIG. 37B, a second-color dot pattern G111 is formed on the second dot line G102. Next, as illustrated in FIG. 37C, a third dot line G103 is formed on the first-color solid image G100, and subsequently, as illustrated in FIG. 37D, a second-color dot pattern G112 is formed on the third dot line G103. After that, the forming of the n-th (n is an integer) dot line of the first-color solid image G100 and the forming of the second-color dot pattern are sequentially performed, so that the dot arrangement pattern illustrated in FIG. 36 is formed.

In the processing of forming the dot arrangement pattern described hereinbefore, as illustrated in FIG. 37C, the state where the second-color dot pattern (singular dots) G111 is formed on the solid image according to the first-color line patterns G101 to G103 occurs. Therefore, in this step, the printing process of step S310 is ended, and by determining the quality of the dot pattern G111 in steps S311 to S315, it is possible to determine the quality of the dot image using the dot pattern of the image forming process.

Next, the process of determining whether or not the dot pattern for analysis which is able to be used as the test pattern exists in step S306 will be described. In the determination process, for example, 2-bit image data for ejection after the image process are used. In the determination process, first, a solid portion of an image (for example, a cyan (C) image) of any one color component of CMYK images divided from RGB original image data is determined and extracted. Whether or not a partial image is a solid image is able to be determined by scanning the image data and determining dot continuity by performing a generally-known labeling process on the image data. An (x, y) coordinate range where the extracted solid image exists is, for example, stored in a memory (not illustrated) or the like. Subsequently, it is determined whether or not a specific dot pattern (for example, 1×1 dots) which has a sufficient margin and a different color component (for example, yellow (Y) exists within the coordinate range of the stored solid image. Similarly to the determination of the solid image, whether or not the specific dot pattern which has a sufficient margin and a different color exists within the coordinate range of the solid image is able to be determined by performing a labeling process or the like. In a case where it is determined that the specific dot pattern which has a sufficient margin and a different color exists within the coordinate range of the solid image, the (x, y) coordinate range (or the coordinate position) of the specific dot pattern is stored in a memory (not illustrated) or the like.

The coordinate range (or the coordinate position) of the specific dot pattern is, for example, used at the time of reading the dot image in step S311.

Next, an addition process of the dot pattern for analysis in step S307 will be described. In the addition process, similarly to the above-described determination process, for example, 2-bit image data for ejection after the image process are used. In the addition process, similarly to the determination process, first, a solid portion of an image (for example, a cyan (C) image) of any one color component of CMYK images divided from RGB original image data is determined and extracted. The (x, y) coordinate range where the extracted solid image exists is, for example, stored in a memory (not illustrated) or the like. Subsequently, with respect to the extracted solid image, a specific dot pattern of a different color component (for example, yellow (Y)) is added to a position or a range having a sufficient margin in the coordinate range. The added specific dot pattern may be a dot pattern where, for example, 1×1 dots or the like are fixed or may be a dot pattern having a size (for example, a dot pattern having a 2×2 size in the case of a solid image having a 6×6 size) selected according to a securable margin. An (x, y) coordinate range (or a coordinate position) of the added specific dot pattern is stored in a memory (not illustrated) or the like. The coordinate range (or the coordinate position) of the specific dot pattern is, for example, used at the time of reading the dot image in step S311.

In addition, in the above-described example, the color of the second-color dot pattern added to the first-color solid image is preferably a color which is difficult to visually recognize when the second-color dot pattern is superimposed on the first-color solid image. For example, in a case where a color of which luminosity is lower than a luminosity of a solid image is superimposed on the solid image, the superimposed color is easy to visually recognize. In this case, the color of the superimposed second-color dot pattern preferably having a color of which luminosity is high. More specifically, if a black dot is superimposed on a color solid image, it is easy to visually recognize the black dot. Therefore, the dot of the color of which luminosity is higher than that of the solid image is preferably formed on the color solid image. This is the same with respect to a black solid image.

According to the configuration described heretofore, in addition to the same effects as those of the first embodiment, it is possible to easily adjust the plasma energy amount during the printing of the actual original image. Since other configurations, operations, and effects are as good as the above-described first embodiment, the description thereof is omitted therein.

According the invention, it is possible to provide a printing apparatus, a printing system, and a method for manufacturing a printed material capable of manufacturing a high quality printed material.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

[Patent Document 1] JP 4662590 B1

[Patent Document 2] JP 2010-188568 A

What is claimed is:

1. A printing apparatus comprising:

a plasma processing unit that processes a surface of a processing object by using plasma;

a recording unit that forms a first-color image on the surface of the processing object by inkjet recording, the surface having been plasma-processed by the plasma processing unit, and forms a second-color image to be superimposed on the first-color image by the inkjet recording; and an adjusting unit that adjusts a plasma energy amount that is to be applied to the processing object according to the second-color image.

2. The printing apparatus according to claim 1, wherein the plasma processing unit acidifies at least the surface of the processing object.

3. The printing apparatus according to claim 1, further comprising:

a reading unit that reads the second-color image recorded by the recording unit; and an analysis unit that analyzes the second-color image read by the reading unit, wherein the adjusting unit adjusts the plasma energy amount according to a result of the analysis of the analysis unit.

4. The printing apparatus according to claim 1, further comprising:

a reception unit that receives an input from a user, wherein the adjusting unit adjusts the plasma energy amount according to the input received by the reception unit.

5. The printing apparatus according to claim 1, wherein the second-color image has a color of which luminosity is lower than luminosity of a color of the first-color image.

6. The printing apparatus according to claim 1, wherein the first-color image has a color of yellow or white, and the second-color image has a color different from the color of the first-color image.

7. The printing apparatus according to claim 1, wherein an ink ejected to the surface of the processing object by the recording unit is an ink where negatively charged pigments are dispersed in a liquid.

8. The printing apparatus according to claim 1, wherein an ink ejected to the surface of the processing object by the recording unit is an aqueous pigment ink.

9. The printing apparatus according to claim 1, wherein the recording unit forms the second-color image in a region that is an inner portion of the first-color image and is an inner side separated from an outer edge of the first-color image.

10. The printing apparatus according to claim 3, wherein the analysis unit analyzes at least one of a dot circularity, a dot diameter, and a deviation of concentration of pigments in the second-color image read by the reading unit.

11. The printing apparatus according to claim 1, wherein the second-color image is a dot pattern where singular dots or plural dots are two-dimensionally arranged or a line pattern where plural dots are arranged in a line shape.

12. The printing apparatus according to claim 1, wherein the plasma processing unit comprises a discharging electrode, and the adjusting unit adjusts the plasma energy amount by adjusting at least one of amplitude or time width of a voltage pulse applied to the discharging electrode.

13. The printing apparatus according to claim 1, wherein the plasma processing unit comprises a plurality of discharging electrodes, and the adjusting unit adjusts the plasma energy amount by changing the number of driving discharging electrodes among the plurality of the discharging electrodes.

14. The printing apparatus according to claim 1, further comprising:

a transporting unit that transports the processing object from the plasma processing unit through the recording unit to the reading unit, wherein the adjusting unit adjusts the plasma energy amount that is to be applied to the processing object by adjusting a transport speed of the processing object.

15. The printing apparatus according to claim 3, further comprising:

a control unit that controls the recording unit to print an original image that is a printing object; and a determination unit that determines whether a region where the second-color image is superimposed on the first-color image exists in a dot arrangement pattern of the original image, wherein the reading unit reads the second-color image of the region that is determined by the determination unit.

16. The printing apparatus according to claim 15, wherein the determination unit determines whether the region where the second-color image is superimposed on the first-color image exists in a process of forming the dot arrangement pattern of the original image.

17. The printing apparatus according to claim 15, further comprising:

an addition unit that adds the dot arrangement pattern where the second-color image is superimposed on the first-color image in the original image, as a result of the determination of the determination unit, when the region where the second-color image is superimposed on the first-color image does not exist in the original image, wherein the reading unit reads the second-color image of the arrangement pattern added by the addition unit.

18. The printing apparatus according to claim 17, wherein the determination unit determines whether the region where the second-color image is superimposed on the first-color image exists within a predetermined range from a distal portion of the original image, and the addition unit adds the dot arrangement pattern where the second-color image is superimposed on the first-color image within the predetermined range from the distal portion of the original image when the determination unit determines that the region does not exist within the predetermined range from the distal portion of the original image.

19. A printing system comprising:

a plasma processing device that processes a surface of a processing object by using plasma; and a recording device that forms a first-color image on the surface of the processing object by inkjet recording, the surface having been plasma-processed by the plasma processing device, and forms a second-color image to be superimposed on the first-color image by the inkjet recording, wherein the printing system comprises an adjusting unit that adjusts a plasma energy amount that is to be applied to the processing object according to the second-color image.

20. A method for manufacturing a printed material where an image is formed on a processing object in an inkjet recording manner, comprising:

processing a surface of the processing object by using plasma;

forming a first-color image on the surface of the processing object by the inkjet recording, the surface having been plasma-processed;

forming a second-color image to be superimposed on the first-color image by the inkjet recording;

adjusting a plasma energy amount that is to be applied to the processing object according to the second-color image; and printing an original image that is a printing object on the processing object that is plasma-processed with the adjusted plasma energy amount.

* * * * *